US006027871A

United States Patent [19]

Katoh

[11] Patent Number: 6,027,871

[45] Date of Patent: Feb. 22, 2000

[54] PREPARATION OF PHOTOTHERMOGRAPHIC MATERIAL

[75] Inventor: Kazunobu Katoh, Kanagawa, Japan

[73] Assignee: Fuji Photo Film Co., Ltd., Kanagawa, Japan

[21] Appl. No.: 08/840,166

[22] Filed: Apr. 14, 1997

[30] Foreign Application Priority Data

Apr. 26, 1996 [JP] Japan ..... 8-130845
Nov. 13, 1996 [JP] Japan ..... 8-316985

[51] Int. Cl.[7] ..... G03C 1/498

[52] U.S. Cl. ..... 430/619; 430/264

[58] Field of Search ..... 430/619, 264, 430/531, 939

[56] References Cited

U.S. PATENT DOCUMENTS 5,464,738 11/1995 Lynch et al. .
5,496,695 3/1996 Simpson et al. .
5,677,121 10/1997 Tsuzuki .

FOREIGN PATENT DOCUMENTS 9704356 2/1997 WIPO .
9704357 2/1997 WIPO .

*Primary Examiner*—Thorl Chea
*Attorney, Agent, or Firm*—Birch, Stewart, Kolasch & Birch, LLP

[57] ABSTRACT

A photothermographic material is prepared by preparing an aqueous dispersion of a thermoplastic resin, adding an organic silver salt and a silver halide to the aqueous dispersion, further adding a ultrahigh contrast promoting agent to the aqueous dispersion to form an aqueous coating solution, applying the aqueous coating solution to a support, and heat drying the coating. Since the use of an aqueous dispersion enables the use of a polycarbonate support which originally has good dimensional stability to heat, a photosensitive material having good dimensional stability is manufactured in high yields.

7 Claims, No Drawings

PREPARATION OF PHOTOTHERMOGRAPHIC MATERIAL

BACKGROUND OF THE INVENTION

1. Field of the Invention

This invention relates to a method for preparing a photothermographic material, especially suited for the manufacture of printing plates.

2. Prior Art

Photothermographic materials which are processed by a photothermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic materials generally contain a reducible silver source (e.g., organic silver salt), a catalytic amount of a photocatalyst (e.g., silver halide), a toner for controlling the tonality of silver, and a reducing agent, typically dispersed in a binder matrix. Photothermographic materials are stable at room temperature. When they are heated at an elevated temperature (e.g., 80° C. or higher) after exposure, a redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, eventually forming an image.

Such photothermographic materials have been used as microphotographic and radiographic photosensitive materials. However, only a few have been used as a graphic printing photosensitive material because the image quality is poor for the printing purpose as demonstrated by low maximum density (Dmax) and soft gradation.

With the recent advance of lasers and light-emitting diodes, scanners and image setters having an oscillation wavelength of 600 to 800 nm find widespread use. There is a strong desire to have a high contrast photosensitive material which has so high sensitivity and Dmax that it may comply with such output devices. Also a need for easy and dry processing is increasing.

U.S. Pat No. 5,464,738 describes that high contrast images are obtainable using sulfonyl hydrazide as a reducing agent for dry silver. However, development does not take place unless the developing temperature is raised as high as 136° C. to 142° C.

Dimensional stability is one of the most important attributes required for photosensitive materials for use as printing plates. As the developing temperature rises, plastic film used as the support undergoes thermal shrinkage, incurring dimensional changes. Such dimensional changes are undesirable because color shift and noise associated with white or black lines appear in printed matter. It is generally desired to restrict a dimensional change to 0.01% or less before and after development.

An attempt was made to lower the heat developing temperature. The attempt succeeded in lowering the temperature, but to about 110° C. At such temperature, supports of polyethylene terephthalate will experience a thermal shrinkage of about 0.1%. Dimensional stability is still insufficient.

On the other hand, it is contemplated to form the support from a material which experiences a minimal dimensional change at elevated temperatures. Such supports are of polycarbonate, polysulfone, polyarylates, polyether sulfone, polyethylene naphthalate, and polyimides. Inter alia, polycarbonate is recommended as a printing plate film support because it is improved in transparency and light transmission in the UV region. The polycarbonate, however, has never been used as the support of photothermographic material used for the above-mentioned purpose because it is readily soluble in organic solvents, especially ketones such as acetone and methyl ethyl ketone. Such solubility is undesirable because photothermographic material is generally prepared by adding an organic solvent solution of a reducing agent to an organic solvent dispersion of organic silver salt and silver halide and coating the resulting solution to a film support. Methyl ethyl ketone is the most popular organic solvent.

The coating step using an organic solvent is one of the factors causing the reduced production yield of the photosensitive material manufacturing process because it is difficult to increase the coating rate and to simultaneously coat multiple layers.

SUMMARY OF THE INVENTION

A primary object of the present invention is to provide a method for preparing a photothermographic material for use in the manufacture of printing plates and having improved dimensional stability. Another object of the present invention is to provide a method for preparing a photothermographic material for use in the manufacture of printing plates, the method enabling coating with water solvent and featuring high productivity.

According to the invention, there is provided a method for preparing a photothermographic material having a layer containing a reducing agent, comprising the steps of preparing an aqueous dispersion of a thermoplastic resin as a coating solution for forming the reducing agent-containing layer or another layer; adding an organic silver salt and a silver halide to the aqueous dispersion; further adding a ultrahigh contrast promoting agent to the aqueous dispersion to form an aqueous coating solution; applying the aqueous coating solution to a support; and heat drying the coating. The method may further include the steps of preparing a water dispersion of the reducing agent by a solid dispersion method and adding the water dispersion to the aqueous dispersion.

In one preferred embodiment, the support is formed of polycarbonate, and the thermoplastic resin is selected from the group consisting of polyvinyl alcohol, cellulose acetate butyrate, cellulose acetate propionate, styrene-butadiene copolymers, polyvinyl acetals, polyurethanes, polyvinyl acetate, acrylic resins and mixtures thereof.

DETAILED DESCRIPTION OF THE INVENTION

According to the invention, a photothermographic material is manufactured by preparing an aqueous dispersion of a thermoplastic resin as a coating solution for forming a photosensitive layer, adding an organic silver salt and a silver halide to the aqueous dispersion, further adding a ultrahigh contrast promoting agent to the aqueous dispersion to form an aqueous coating solution, applying the aqueous coating solution to a support, and heat drying the coating.

The manufacture of a photothermographic material using an aqueous dispersion as mentioned above permits a substance having improved dimensional stability to temperature as typified by polycarbonate to be used as the support. Then a photothermographic material having improved dimensional stability is obtained.

While a photothermographic material is somewhat improved in dimensional stability by properly selecting components to be added thereto (for example, reducing agent and hydrazine derivative) so as to lower the heat developing temperature, the present invention is successful in further improving the dimensional stability. The use of a water dispersion enabling the use of a more dimensionally stable support cooperates with the lowering of heat developing temperature to exert a synergistic effect of minimizing a dimensional change before and after heat development. Specifically, the material merely experiences a dimensional change of up to 0.04%, especially 0.001 to 0.01% in both longitudinal and transverse directions at a heat developing temperature of about 60 to 120° C. Since a prior art photothermographic material which is designed so as to lower the heat developing temperature and uses a common polyethylene terephthalate (PET) support experiences a dimensional change of about 0.1%, the invention achieves an improvement in dimensional stability by a factor of 2.5 to 100.

As a result of improvement in dimensional stability, there is obtained an image with less noise. The use of an aqueous solvent is also effective in improving productivity.

The ultrahigh contrast promoting agent used herein is described in detail. The ultrahigh contrast promoting agent is an agent which does not function as a developing agent when used alone, but cooperates with a reducing agent as a developing agent to form a ultrahigh contrast image. Therefore, the concept, function and result of a ultrahigh contrast promoting agent are different from a mere combination of reducing agents.

Often the ultrahigh contrast promoting agent is selected from hydrazine derivatives and compounds containing a quaternary nitrogen atom. Hydrazine derivatives useful as the ultrahigh contrast promoting agent are of the following general formula (I).

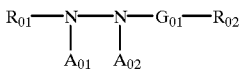

(I)

In formula (I), $R_{01}$ is an aliphatic or aromatic group. $R_{02}$ is a hydrogen atom, alkyl, aryl, unsaturated heterocyclic, alkoxy, aryloxy, amino or hydrazino group. $G_{01}$ is a group represented by:

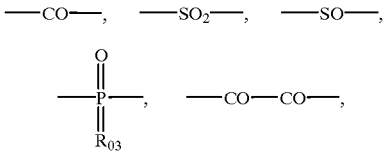

or a thiocarbonyl or iminomethylene group. $A_{01}$ and $A_{02}$ are both hydrogen atoms, or one of $A_{01}$ and $A_{02}$ is a hydrogen atom and the other is a substituted or unsubstituted alkylsulfonyl group, substituted or unsubstituted arylsulfonyl group or substituted or unsubstituted acyl group. $R_{03}$ is a group selected from the same range as defined for $R_{02}$ and may be identical with or different from $R_{02}$.

In formula (I), the aliphatic groups represented by $R_{01}$ are preferably those having 1 to 30 carbon atoms, especially normal, branched or cyclic alkyl groups having 1 to 20 carbon atoms. The branched alkyl group may be cyclized so as to form a saturated heterocyclic containing one or more hetero atoms. The alkyl group may have a substituent.

In formula (I), the aromatic groups represented by $R_{01}$ are preferably monocyclic or dicyclic aryl groups and unsaturated heterocyclic groups. The unsaturated heterocyclic group may be fused to a monocyclic or dicyclic aryl group to form a heteroaryl group. Exemplary are monovalent groups derived from benzene, naphthalene, pyridine, pyrimidine, imidazole, pyrazole, quinoline, isoquinoline, benzimidazole, thiazole, and benzothiazole rings. Groups containing a benzene ring are preferred.

Aryl is the most preferred group of $R_{01}$.

The aliphatic or aromatic group represented by $R_{01}$ may have a substituent. Exemplary substituents include an alkyl group (inclusive of aralkyl groups), alkenyl group, alkynyl group, aryl group, heterocyclic-containing group, pyridinium group, hydroxy group, alkoxy group, aryloxy group, acyloxy group, alkyl or arylsulfonyloxy group, amino group, carbonamide group, sulfonamide group, ureido group, thioureido group, semicarbazide group, thiosemicarbazide group, urethane group, hydrazide structure-bearing group, quaternary ammonium structure-bearing group, alkyl or arylthio group, alkyl or arylsulfonyl group, alkyl or arylsulfinyl group, carboxyl group, sulfo group, acyl group, alkoxy or aryloxycarbonyl group, carbamoyl group, sulfamoyl group, halogen atom, cyano group, nitro group, nitrosyl group, phosphoric acid amide group, diacylamino group, imide group, acyl urea structure-bearing group, selenium or tellurium atom-containing group, and tertiary or quaternary sulfonium structure-bearing group. Desired among these groups are normal, branched or cyclic alkyl groups preferably having 1 to 20 carbon atoms, aralkyl groups, especially monocyclic or dicyclic aralkyl groups whose alkyl moiety has 1 to 3 carbon atoms, alkoxy groups preferably having 1 to 20 carbon atoms, substituted amino groups, especially amino groups having an alkyl substituent of 1 to 20 carbon atoms, acylamino groups preferably having 2 to 30 carbon atoms, sulfonamide groups preferably having 1 to 30 carbon atoms, ureido groups preferably having 1 to 30 carbon atoms, and phosphoric acid amide groups preferably having 1 to 30 carbon atoms.

In formula (I), the alkyl groups represented by $R_{02}$ are preferably those having 1 to 4 carbon atoms, and the aryl groups are preferably monocyclic or dicyclic aryl groups, for example, a benzene ring-containing group.

The unsaturated heterocyclic groups represented by $R_{02}$ are preferably 5 or 6-membered rings containing at least one of nitrogen, oxygen and sulfur atoms, for example, imidazolyl, pyrazolyl, triazolyl, tetrazolyl, pyridyl, pyridinium, quinolinium, and quinolinyl groups, with the pyridyl and pyridinium groups being especially preferred.

The alkoxy groups represented by $R_{02}$ are preferably those having 1 to 8 carbon atoms, the aryloxy groups are preferably monocyclic, the amino groups are preferably unsubstituted amino, alkylamino groups having 1 to 10 carbon atoms, and arylamino groups having up to 10 carbon atoms.

The groups represented by $R_{02}$ may be substituted ones while preferred substituents are as exemplified for the substituent on $R_{01}$.

Where $G_{01}$ is a —CO— group, the preferred groups represented by $R_{02}$ are a hydrogen atom, alkyl groups (e.g., methyl, trifluoromethyl, 3-hydroxypropyl, 3-methanesulfonamidopropyl, and phenylsulfonylmethyl), aralkyl groups (e.g., o-hydroxybenzyl), aryl groups (e.g., phenyl, 3,5-dichlorophenyl, o-methanesulfonamidophenyl, 4-methanesulfonylphenyl, and 2-hydroxymethylphenyl), and —$C_2F_4COOM$ wherein M is a hydrogen atom or alkali metal atom.

Where $G_{01}$ is a —$SO_2$— group, the preferred groups represented by $R_{02}$ are alkyl groups (e.g., methyl), aralkyl groups (e.g., o-hydroxybenzyl), aryl groups (e.g., phenyl), and substituted amino groups (e.g., dimethylamino).

Where $G_{01}$ is a —COCO— group, the preferred groups represented by $R_{02}$ are alkoxy, aryloxy, and amino groups.

In formula (I), $G_{01}$ is preferably a —CO— or —COCO— group, most preferably a —CO— group.

$R_{02}$ may be such a group as to induce cyclization reaction to cleave a $G_{01}$-$R_{02}$ moiety from the remaining molecule to generate a cyclic structure containing the atoms of the -$G_{01}$-$R_{02}$ moiety. Such examples are described in JP-A 29751/1988, for example.

Hydrazine derivatives having at least one nitro or nitrosyl group in $R_{01}$ or $R_{02}$ are preferred. Hydrazine derivatives having at least one nitro or nitrosyl group in $R_{01}$ are especially preferred.

In formula (I), each of $A_{01}$ and $A_{02}$ is a hydrogen atom, or a substituted or unsubstituted alkyl or arylsulfonyl group having up to 20 carbon atoms (preferably a phenylsulfonyl group or a phenylsulfonyl group substituted such that the sum of Hammette's substituent constants may be −0.5 or more), or substituted or unsubstituted acyl group having up to 20 carbon atoms (preferably a benzoyl group, a benzoyl group substituted such that the sum of Hammette's substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxyl group and sulfonate group).

Most preferably, both $A_{01}$ and $A_{02}$ are hydrogen atoms.

The substituent on $R_{01}$ and $R_{02}$ may be further substituted, with preferred examples of the further substituent being those groups exemplified as the substituent on $R_{01}$. The further substituent, in turn, may be further substituted, the still further substituent, in turn, may be further substituted, and so on. In this way, multiple substitution is acceptable while preferred substituents are those groups exemplified as the substituent on $R_{01}$.

$R_{01}$ and $R_{02}$ in formula (I) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R_{01}$ and $R_{02}$ in formula (I) may have incorporated therein a group for enhancing adsorption to the surface of silver halide grains. Such adsorptive groups include alkylthio, arylthio, thiourea, heterocyclic thioamide, mercapto heterocyclic and triazole groups as described in U.S. Pat Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988.

Illustrative, non-limiting, examples of the compound represented by formula (I) are given below.

I-1

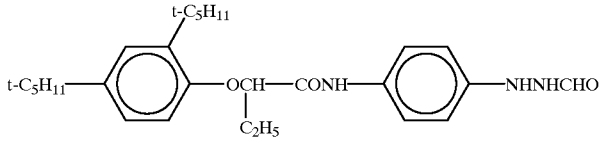

I-2

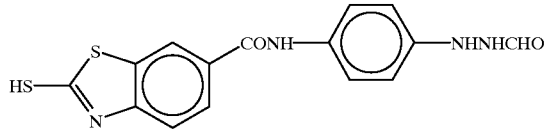

I-3

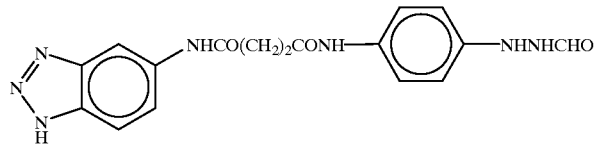

I-4

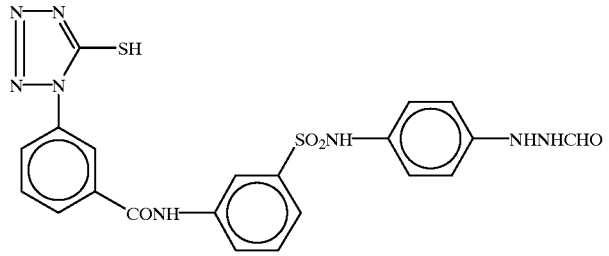

-continued
I-5
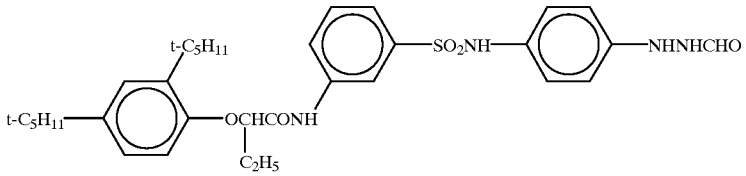
I-6
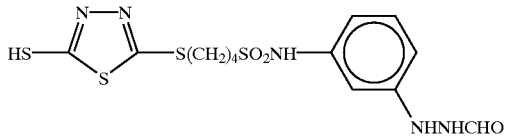
I-7
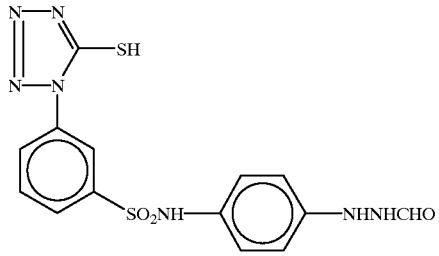
I-8
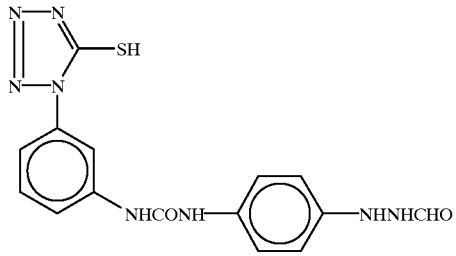
I-9
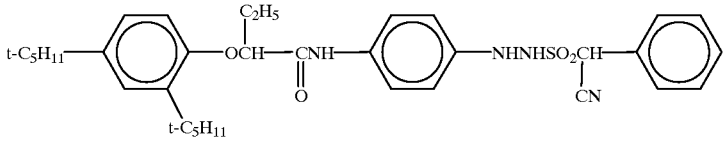
I-10
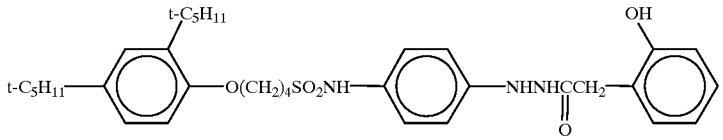
I-11
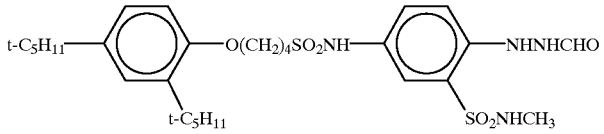
I-12
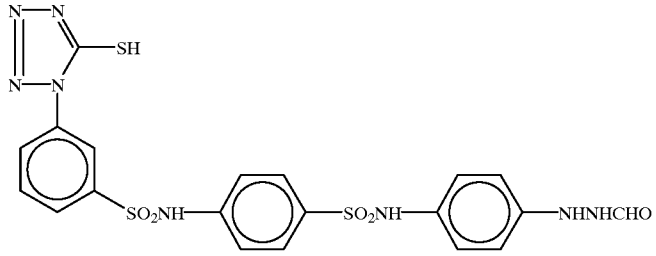

-continued
I-13
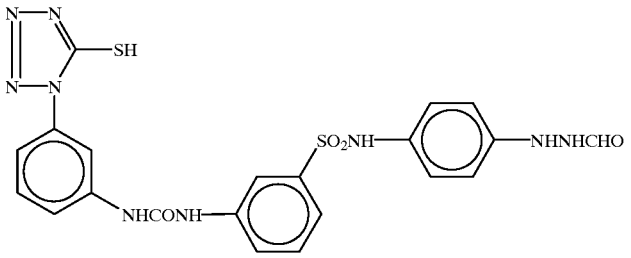
I-14
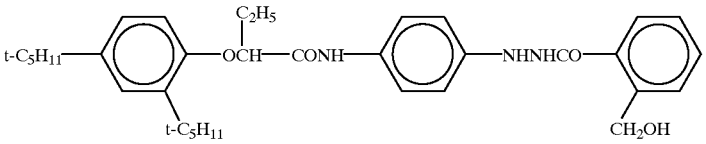
I-15
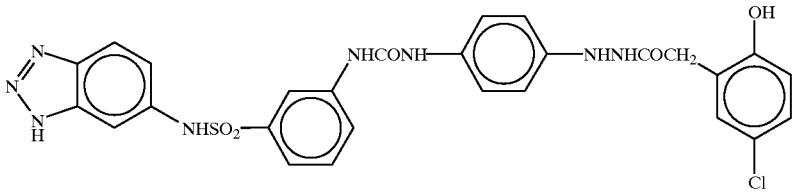
I-16
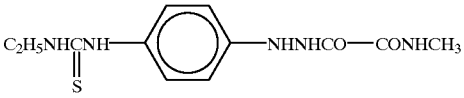
I-17
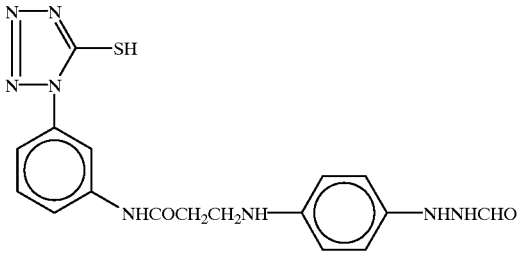
I-18
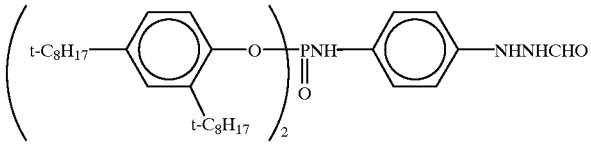
I-19
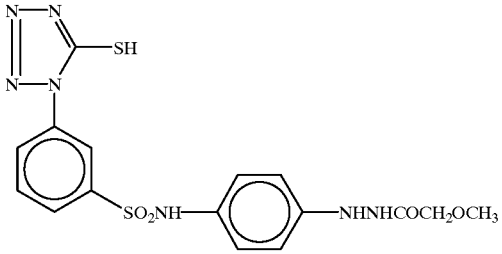

-continued
I-20
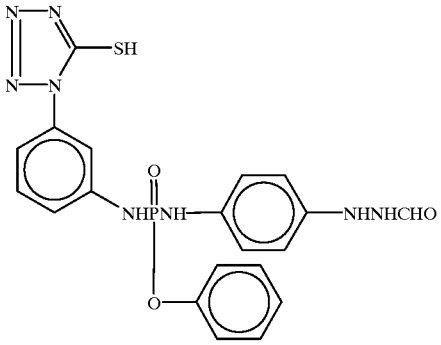
I-21
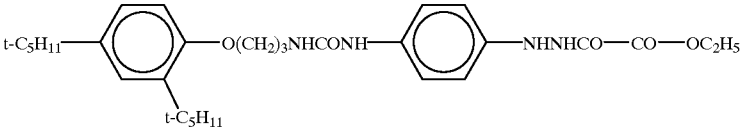
I-22
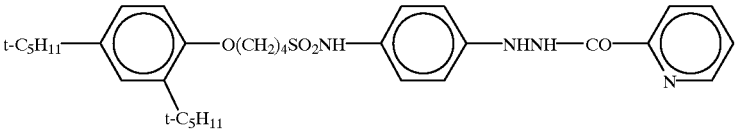
I-23
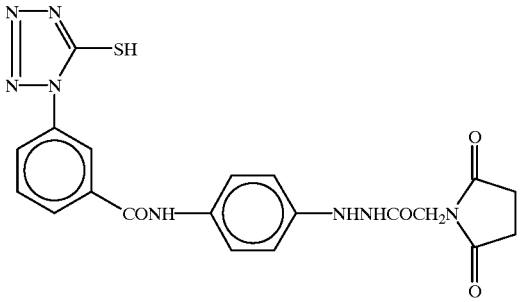
I-24
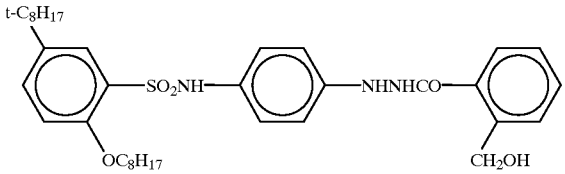
I-25
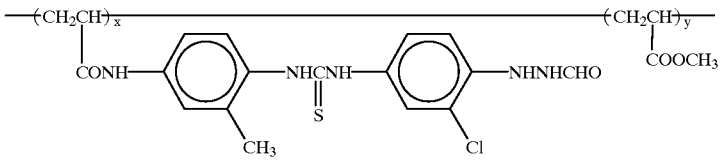
x:y = 3:97
average molecular weight ~ 100,000
I-26
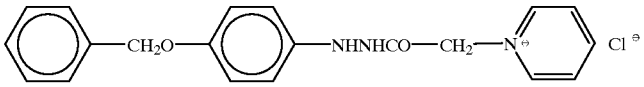
I-27
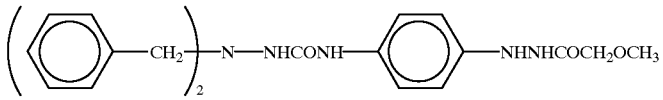

-continued
I-28
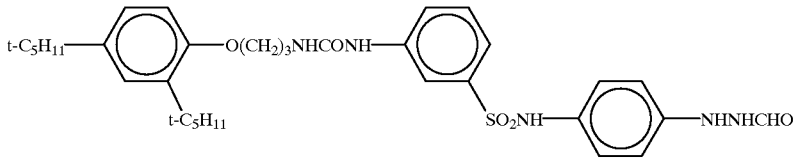
I-29
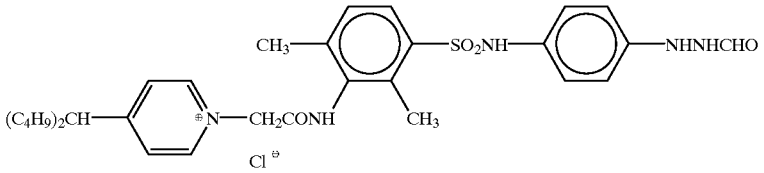
I-30
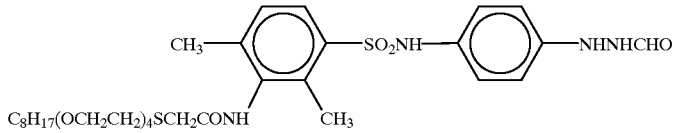
I-31
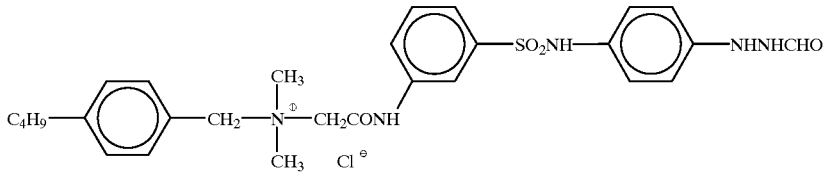
I-32
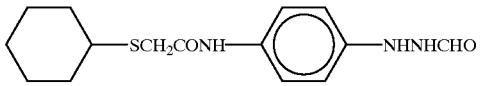
I-33
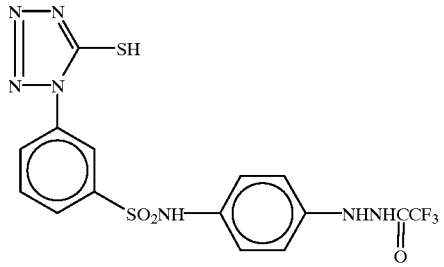
I-34
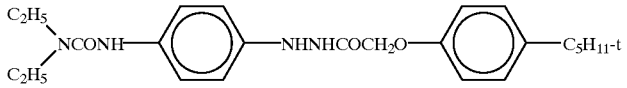
I-35
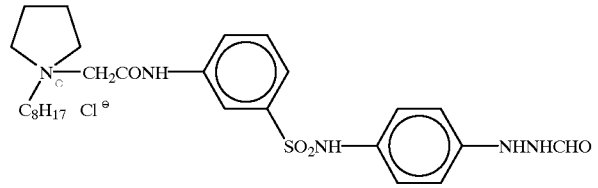
I-36
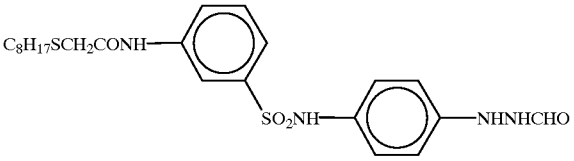

-continued
I-37
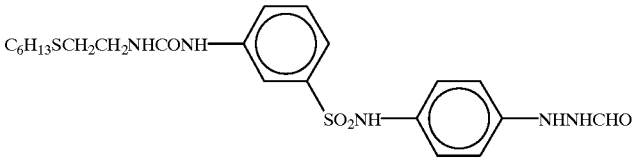
I-38
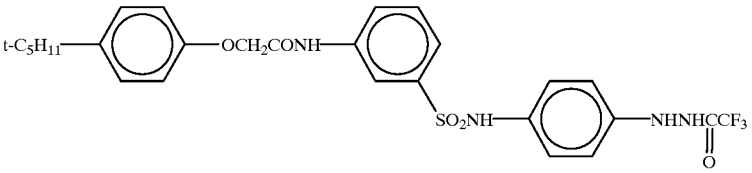
I-39
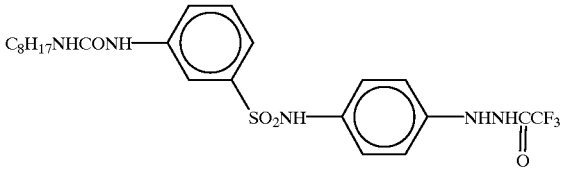
I-40
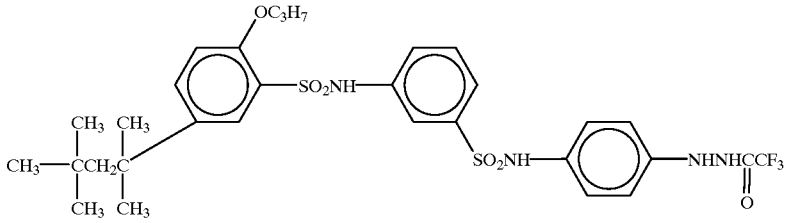
I-41
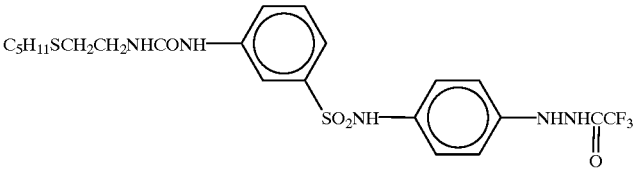
I-42
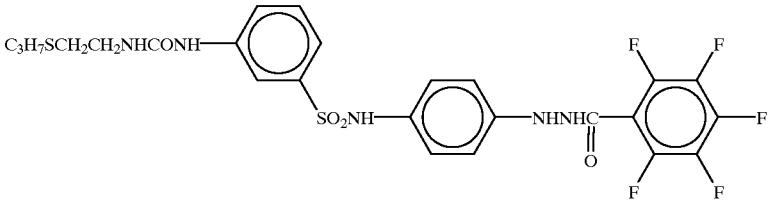
I-43
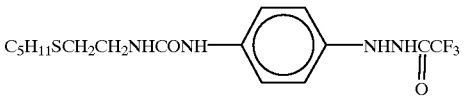
I-44
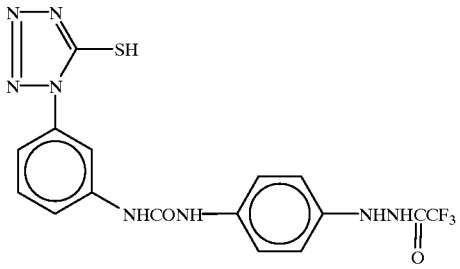

-continued
I-45
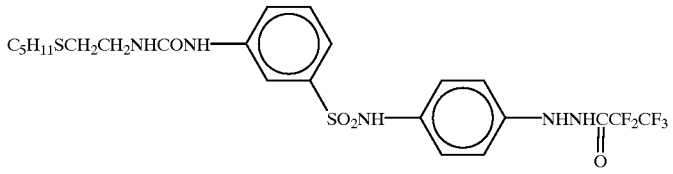
I-46
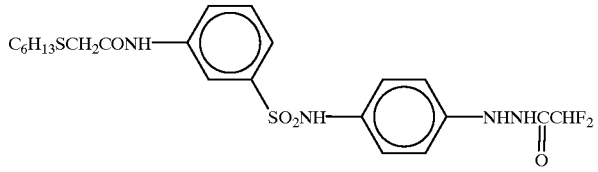
I-47
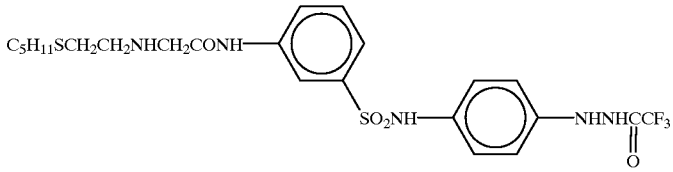
I-48
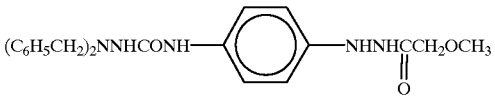
I-49
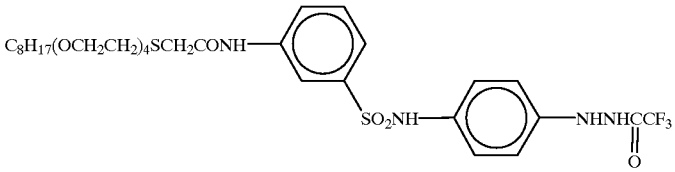
I-50
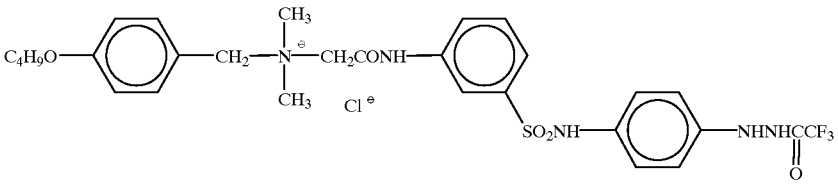
I-51
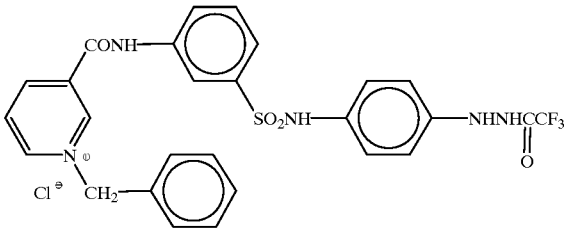
I-52
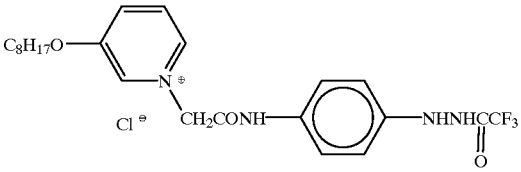

-continued
I-53
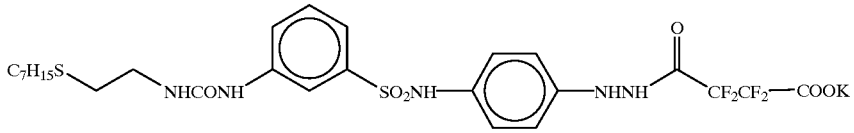
I-54
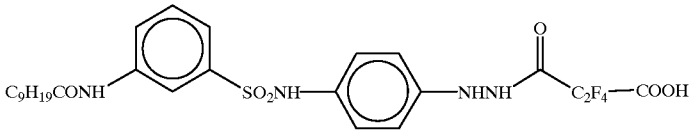
I-55
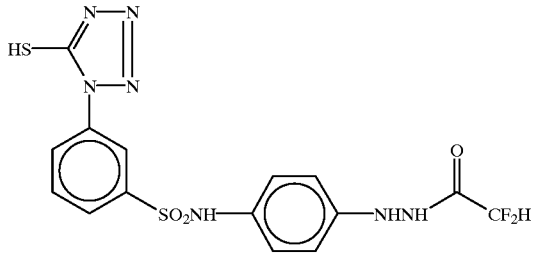
I-56
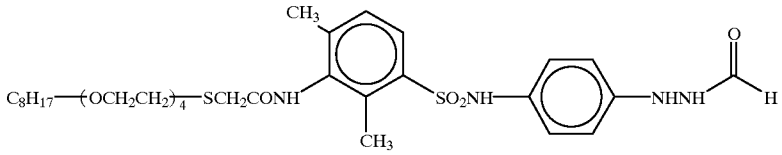
I-57
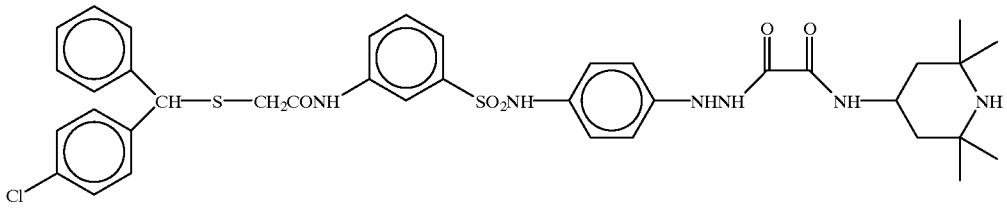
I-58
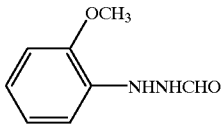
I-59
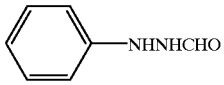
I-60
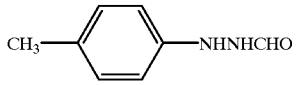
I-61
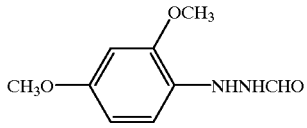

-continued
I-62
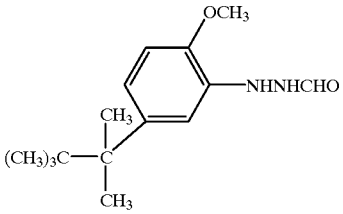
I-63
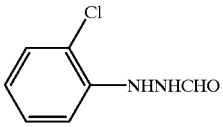
I-64
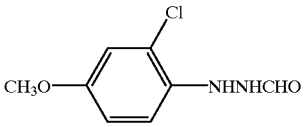
I-65
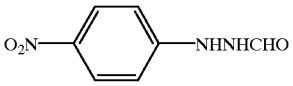
I-66
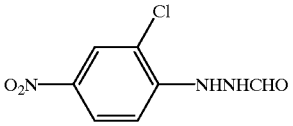
I-67
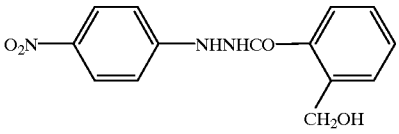
I-68
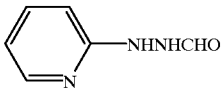
I-69
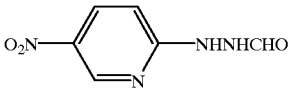
I-70
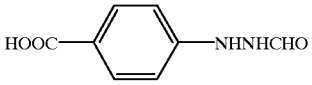
I-71
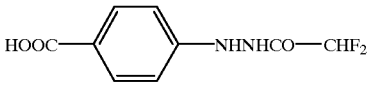
I-72
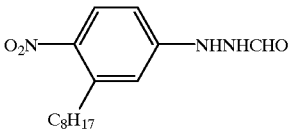

-continued

I-73

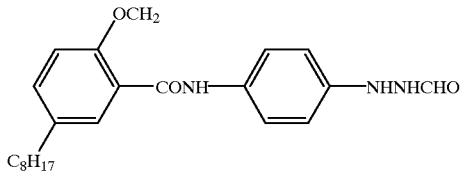

I-74

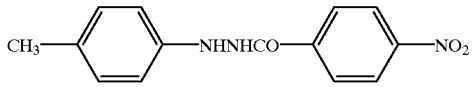

I-75

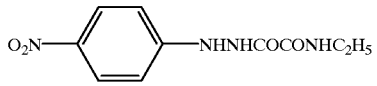

I-76

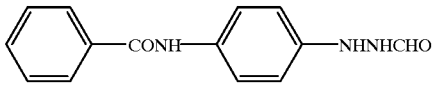

In addition to the above-mentioned examples, the hydrazine derivatives which can be used herein include those examples described in Research Disclosure, Item 23516 (November 1983, page 346), the references cited therein, and the following patents.

| | | | |
|---|---|---|---|
| U.S. Pat. No. | 4,080,207 | 4,269,929 | 4,276,364 |
| | 4,278,748 | 4,385,108 | 4,459,347 |
| | 4,478,928 | 4,560,638 | 4,686,167 |
| | 4,912,016 | 4,988,604 | 4,994,365 |
| | 5,041,355 | 5,104,769 | |
| UKP | 2,011,391B | | |
| EP | 217,310 | 301,799 | 356,898 |
| JP-A | 179734/1985 | 170733/1986 | 270744/1986 |
| | 178246/1987 | 270948/1987 | 29751/1988 |
| | 32538/1988 | 104047/1988 | 121838/1988 |
| | 129337/1988 | 223744/1988 | 234244/1988 |
| | 234245/1988 | 234246/1988 | 294552/1988 |
| | 306438/1988 | 10233/1989 | 90439/1989 |
| | 100530/1989 | 105941/1989 | 105943/1989 |
| | 276128/1989 | 280747/1989 | 283548/1989 |
| | 283549/1989 | 285940/1989 | 2541/1990 |
| | 77057/1990 | 139538/1990 | 196234/1990 |
| | 196235/1990 | 198440/1990 | 198441/1990 |
| | 198442/1990 | 220042/1990 | 221953/1990 |
| | 221954/1990 | 285342/1990 | 285343/1990 |
| | 289843/1990 | 302750/1990 | 304550/1990 |
| | 37642/1991 | 54549/1991 | 125134/1991 |
| | 184039/1991 | 240036/1991 | 240037/1991 |
| | 259240/1991 | 280038/1991 | 282536/1991 |
| | 51143/1992 | 56842/1992 | 84134/1992 |
| | 230233/1990 | 96053/1992 | 216544/1992 |
| | 45761/1993 | 45762/1993 | 45763/1993 |
| | 45764/1993 | 45765/1993 | |

Japanese Patent Application No. 94925/1993

Besides, the following hydrazine derivatives are also useful. Exemplary compounds include the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; and the compounds of the general formulae (H) and (Ha) in JP-A 104426/1995, more specifically compounds H-1 to H-44 described on pages 8 to 15 of the same.

The hydrazine derivative is preferably used in an amount of $1\times10^{-6}$ mol to $1\times10^{-1}$ mol, more preferably $1\times10^{-5}$ mol to $5\times10^{-2}$ mol per mol of total silver available from the organic silver salt and silver halide combined.

In the practice of the invention, an indazole, typically nitroindazole is preferably used as an antifoggant in combination with the hydrazine derivative.

In the photothermographic material of the invention, a nucleation promoter is preferably added in combination with the hydrazine derivative. The nucleation promoter used herein includes amine derivatives, onium salts, disulfide derivatives, and hydroxylamine derivatives. Examples of the nucleation promoter are compounds A-1 to A-47 described in Japanese Patent Application No. 266204/1995.

The other typical ultrahigh contrast promoting agent is a compound containing a quaternary nitrogen atom, which is generally selected from pyridinium compounds of the following formulae (Pa), (Pb) and (Pc), quinolinium compounds, and tetrazolium compounds of the formula (T) shown later. First, the pyridinium compounds are described.

(Pa)

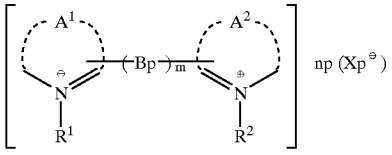

(Pb)

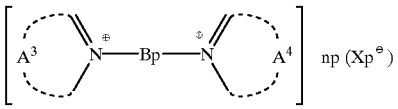

(Pc)

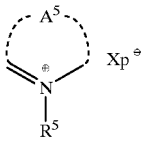

In formulae (Pa), (Pb) and (Pc), each of $A^1$, $A^2$, $A^3$, $A^4$, and $A^5$ is a group of non-metallic atoms necessary to complete a nitrogenous heterocyclic ring which may contain an oxygen, nitrogen or sulfur atom and have a benzene ring fused thereto. The heterocyclic ring formed by $A^1$, $A^2$, $A^3$, $A^4$ or $A^5$ may have a substituent which may be identical or different among $A^1$, $A^2$, $A^3$, $A^4$, and $A^5$. Exemplary substituents include alkyl, aryl, aralkyl, alkenyl, alkynyl, halogen, acyl, alkoxycarbonyl, aryloxycarbonyl, sulfo, carboxy, hydroxy, alkoxy, aryloxy, amide, sulfamoyl, carbamoyl, ureido, amino, sulfonamide, sulfonyl, cyano, nitro, mercapto, alkylthio, and arylthio groups. Preferred exemplary rings formed by $A^1$, $A^2$, $A^3$, $A^4$, and $A^5$ are five and six-membered rings such as pyridine, imidazole, thiozole, oxazole, pyrazine, and pyrimidine rings, with the pyridine ring being most preferred.

Bp is a divalent linking group which is selected from an alkylene group, arylene group, alkenylene group, —$SO_2$—, —SO—, —O—, —S—, —CO—, and —N($R^6$)— wherein $R^6$ is an alkyl group, aryl group or hydrogen atom, alone or in admixture. Preferably Bp is an alkylene or alkenylene group.

Each of $R^1$, $R^2$, and $R^5$ is an alkyl group having 1 to 20 carbon atoms. $R^1$ and $R^2$ may be the same or different. The alkyl group may be a substituted or unsubstituted one, with exemplary substituents being the same as those exemplified as the substituent on $A^1$, $A^2$, $A^3$, $A^4$, and $A^5$. Preferably, each of $R^1$, $R^2$, and $R^5$ is an alkyl group having 4 to 10 carbon atoms. More preferred are unsubstituted alkyl groups or aryl-substituted alkyl groups.

Xp is a counter ion necessary to provide an electric charge balance throughout the molecule, for example, a chloride, bromide, iodide, nitrate, sulfate, p-toluene-sulfonate, and oxalate ion. Letter np represents a number of counter ions necessary to provide an electric charge balance throughout the molecule, with np=0 in the case of an intramolecular salt.

Illustrative, non-limiting, examples of the pyridinium compound which can be used herein are given below.

P-1

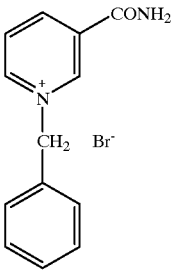

P-2

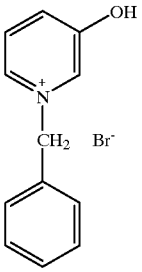

-continued
P-3
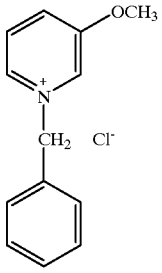
P-4
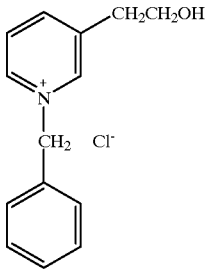
P-5
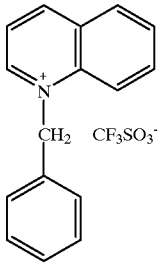
P-6
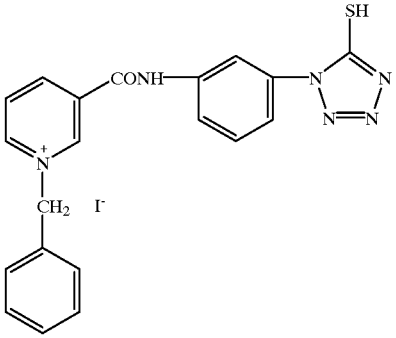
P-7
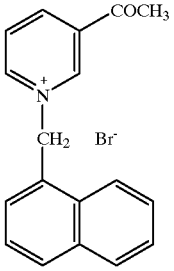

-continued
P-8
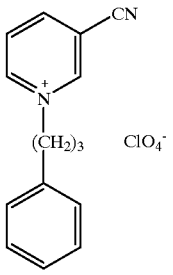
P-9
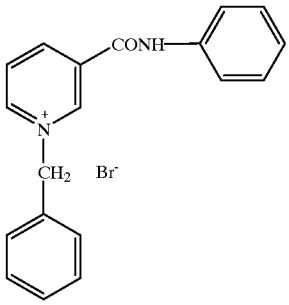
P-10
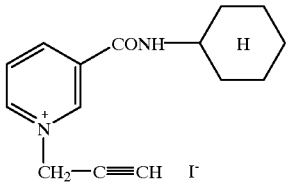
P-11
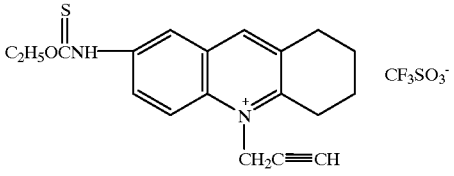
P-12
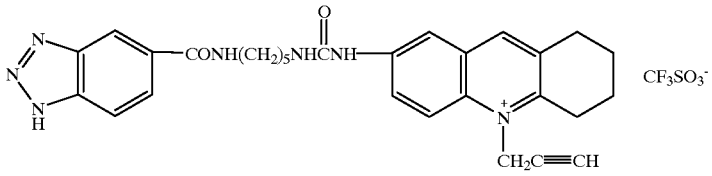
P-13
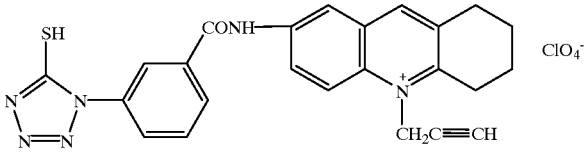

-continued
P-14
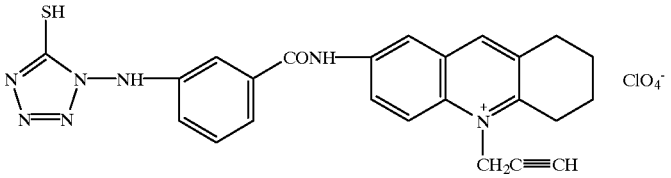
P-15
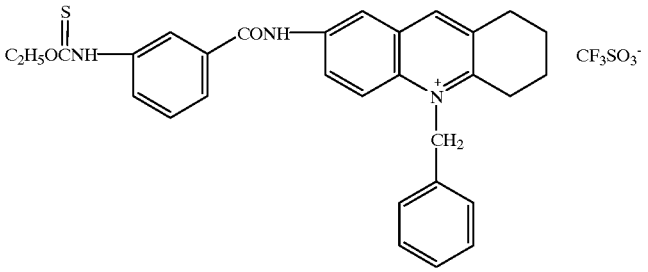
P-16
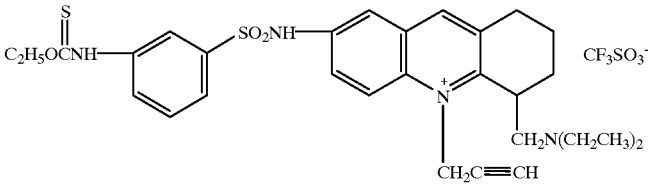
P-17
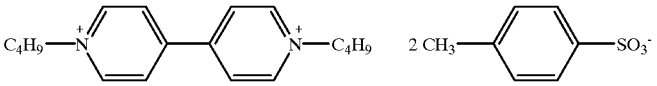
P-18
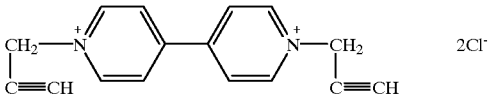
P-19
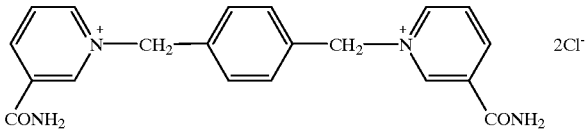
P-20
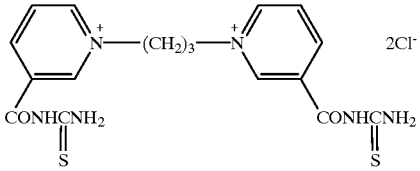
P-21
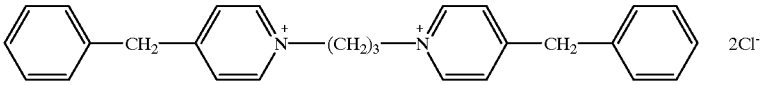

-continued

P-22

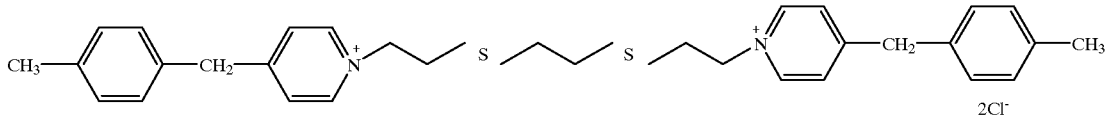

P-23

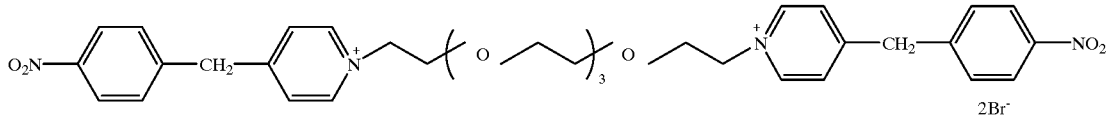

P-24

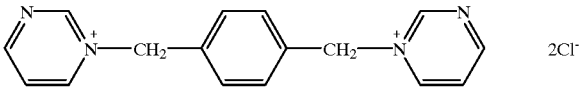

P-25

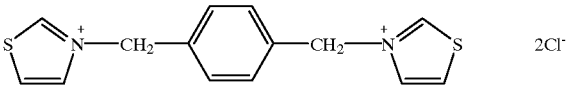

P-26

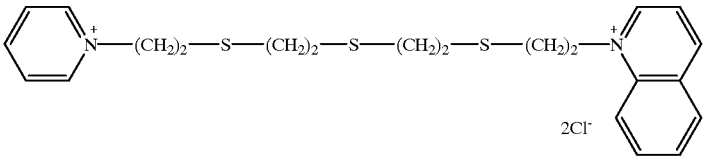

Another example of the compound containing a quaternary nitrogen atom is a triphenyltetrazolium compound of the following formula (T).

(T)

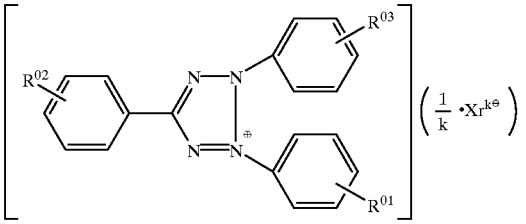

In formula (T), each of substituents $R^{01}$, $R^{02}$ and $R^{03}$ on the phenyl group is preferably a hydrogen atom or electron attractive group having a negative Hammette's sigma value ($\sigma_p$). Hammette's sigma value associated with phenyl substitution is found in the literature, for example, the article of C. Hansch et al. in Journal of Medical Chemistry, vol. 20, 304 (1977), Preferred groups having a negative Hammette's sigma value include methyl ($\sigma_p$=−0.17), ethyl (−0.15), cyclopropyl (−0.21), n-propyl (−0.13), isopropyl (−0.15), cyclobutyl (−0.15), n-butyl (−0.16), isobutyl (−0.20), n-pentyl (−0.15), cyclohexyl (−0.22), amino (−0.66), acetylamino (−0.15), hydroxyl (−0.37), methoxy (−0.27), ethoxy (−0.24), propoxy (−0.25), butoxy (−0.32), and pentoxy (−0.34). All these groups are useful as the substituent on the compound of formula (T).

Letter k is equal to 1 or 2. The anion represented by $Xr^{k-}$ includes, for example, halide ions such as chloride, bromide and iodide ions; residues of inorganic acids such as nitric acid, sulfuric acid and perchloric acid; residues of organic acids such as sulfonic acid and carboxylic acids; and anionic surfactants, for example, lower alkylbenzenesulfonate anions such as p-toluenesulfonate anion, higher alkylbenzenesulfonate anions such as p-dodecylbenzenesulfonate anion, highly alkyl sulfate anions such as lauryl sulfate anion, borate anions such as tetraphenylboron, dialkylsulfosuccinate anions such as di-2-ethylhexylsulfosuccinate anion, polyether alcohol sulfate anions such as cetyl polyethenoxysulfate anion, higher aliphatic anions such as stearate anion, and polymers with an acid residue attached such as polyacrylate anion.

Illustrative, non-limiting, examples of the tetrazolium compound of formula (T) are shown below using a combination of $R^{01}$, $R^{02}$, $R^{03}$, and $Xr^{k-}$.

| compound No. | $R^{01}$ | $R^{02}$ | $R^{03}$ | $Xr^{k\ominus}$ |
|---|---|---|---|---|
| T-1 | H | H | p-$CH_3$ | $Cl^{\ominus}$ |
| T-2 | p-$CH_3$ | H | p-$CH_3$ | $Cl^{\ominus}$ |
| T-3 | p-$CH_3$ | p-$CH_3$ | p-$CH_3$ | $Cl^{\ominus}$ |
| T-4 | H | p-$CH_3$ | p-$CH_3$ | $Cl^{\ominus}$ |
| T-5 | p-$OCH_3$ | p-$CH_3$ | p-$CH_3$ | $Cl^{\ominus}$ |
| T-6 | p-$OCH_3$ | H | p-$CH_3$ | $Cl^{\ominus}$ |
| T-7 | p-$OCH_3$ | H | p-$OCH_3$ | $Cl^{\ominus}$ |
| T-8 | m-$C_2H_5$ | H | m-$C_2H_5$ | $Cl^{\ominus}$ |
| T-9 | p-$C_2H_5$ | p-$C_2H_5$ | p-$C_2H_5$ | $Cl^{\ominus}$ |
| T-10 | p-$C_3H_7$ | H | p-$C_3H_7$ | $Cl^{\ominus}$ |
| T-11 | p-iso$C_3H_7$ | H | p-iso$C_3H_7$ | $Cl^{\ominus}$ |
| T-12 | p-$OC_2H_5$ | H | p-$OC_2H_5$ | $Cl^{\ominus}$ |
| T-13 | p-$OCH_3$ | H | p-iso$C_3H_7$ | $Cl^{\ominus}$ |
| T-14 | H | H | p-n$C_{12}H_{25}$ | $Cl^{\ominus}$ |
| T-15 | p-n$C_{12}H_{25}$ | H | p-n$C_{12}H_{25}$ | $Cl^{\ominus}$ |

-continued

| compound No. | $R^{01}$ | $R^{02}$ | $R^{03}$ | $X_r^{k\ominus}$ |
|---|---|---|---|---|
| T-16 | H | p-$NH_2$ | H | $Cl^{\ominus}$ |
| T-17 | p-$NH_2$ | H | H | $Cl^{\ominus}$ |
| T-18 | p-$CH_3$ | H | p-$CH_3$ | $ClO_4^{\ominus}$ |

The above-mentioned tetrazolium compounds can be readily synthesized according to the method described in Chemical Reviews, vol. 55, pages 335–483, for example. The tetrazolium compounds of formula (T) may be used alone or in admixture of two or more in any desired ratio.

The hydrazine derivatives, pyridinium compounds, quinolinium compounds, and tetrazolium compounds which are used as the ultrahigh contrast promoting agent according to the invention may be used to any layer which is disposed on the same side as the silver halide emulsion layer with respect to the support although they are preferably added to the silver halide emulsion layer or a layer disposed adjacent thereto. Although the optimum amount of the pyridinium, quinolinium or tetrazolium compound added varies with the size and composition of silver halide grains, degree of chemical sensitization and the type of inhibitor, the amount is preferably $1\times10^{-6}$ mol to $1\times10^{-1}$ mol, more preferably $1\times10^{-5}$ mol to $1\times10^{-2}$ mol per mol of silver halide as in the case of hydrazine derivatives.

In the practice of the invention, the ultrahigh contrast promoting agent is used after it is dissolved in water or a water-miscible organic solvent such as methanol, ethanol, dimethylformamide, and acetonitrile.

A well-known emulsifying dispersion method is used for dissolving the ultrahigh contrast promoting agent with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the ultrahigh contrast promoting agent in powder form in water in a ball mill, colloidal mill or ultrasonic mixer. Also, the ultrahigh contrast promoting agent may be contained in microparticulates of a polymer as described in JP-A 948/1990.

Among others, hydrazine derivatives are most preferred ultrahigh contrast promoting agents.

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly greater amount of about 2 to 15% by weight of that layer.

For photothermographic materials using organic silver salts, a wide range of reducing agents or developing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5 -methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palpitate and ascorbin stearate; aldehydes and ketones such as benzil and diacetyl; 3-pyrazolidones and certain indane-1,3-diones.

Especially preferred reducing agents used herein are those compounds of the following formulae (R-I), (R-II), (R-III), and (R-IV).

(R-I)

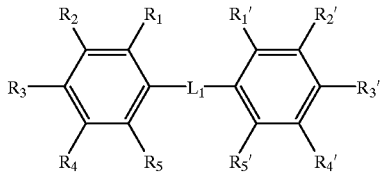

(R-II)

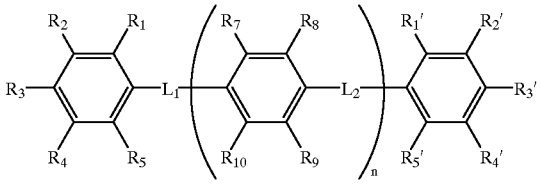

(R-III)

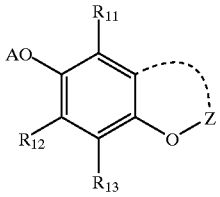

-continued (R-IV)

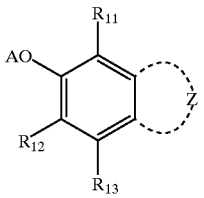

In formula (R-III), Z forms a cyclic structure represented by the following formula (Z-1) or (Z-2).

(Z-1)

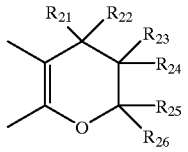

or (Z-2)

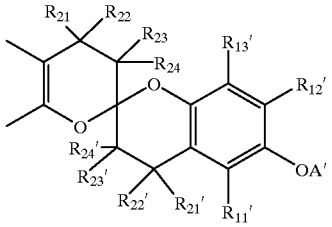

In formula (R-IV), Z forms a cyclic structure represented by the following formula (Z-3) or (Z-4).

(Z-3)

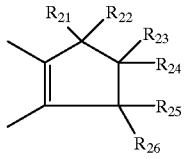

or (Z-4)

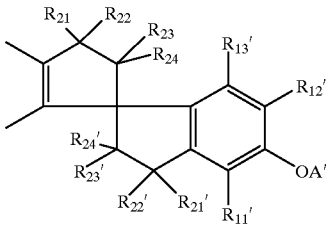

In formulae (R-I) and (R-II), each of $L_1$ and $L_2$ is a group CH—$R_6$ or a sulfur atom, and n is a natural number.

Herein, R is used as a representative of $R_1$ to $R_{10}$, $R_1'$ to $R_5'$, $R_{11}$ to $R_{13}$, $R_{11}'$ to $R_{13}'$, $R_{21}$ to $R_{26}$, and $R_{21}'$ to $R_{24}'$. R is a hydrogen atom, alkyl group having 1 to 30 carbon atoms, aryl group, aralkyl group, halogen atom, amino group or a substituent represented by —O-A, with the proviso that at least one of $R_1$ to $R_5$, at least one of $R_1'$ to $R_5'$, and at least one of $R_7$ to $R_{10}$ each are a group represented by —O-A. Alternatively, R groups, taken together, may form a ring. A and A' each are a hydrogen atom, alkyl group having 1 to 30 carbon atoms, acyl group having 1 to 30 carbon atoms, aryl group, phosphate group or sulfonyl group. R, A and A' may be substituted groups while typical examples of the substituent include an alkyl group (including active methine groups), nitro group, alkenyl group, alkynyl group, aryl group, heterocyclic ring-containing group, group containing a quaternized nitrogen atom-containing heterocyclic ring (e.g., pyridinio group), hydroxyl group, alkoxy group (including a group containing recurring ethyleneoxy or propyleneoxy units), aryloxy group, acyloxy group, acyl group, alkoxycarbonyl group, aryloxycarbonyl group, carbamoyl group, urethane group, carboxyl group, imido group, amino group, carbonamide group, sulfonamide group, ureido group, thioureido group, sulfamoylamino group, semicarbazide group, thiosemicarbazide group, hydrazino-containing group, quaternary ammonio-containing group, mercapto group, (alkyl, aryl or heterocyclic) thio group, (alkyl or aryl) sulfonyl group, (alkyl or aryl) sulfinyl group, sulfo group, sulfamoyl group, acylsulfamoyl group, (alkyl or aryl) sulfonylureido group, (alkyl or aryl) sulfonylcarbamoyl group, halogen atom, cyano group, phosphoric acid amide group, phosphate structure-containing group, acylurea structure-bearing group, selenium or tellurium atom-containing group, and tertiary or quaternary sulfonium structure-bearing group. The substituent on R, A and A' may be further substituted, with preferred examples of the further substituent being those groups exemplified as the substituent on R. The further substituent, in turn, may be further substituted, the still further substituent, in turn, may be further substituted, and so on. In this way, multiple substitution is acceptable while preferred substituents are those groups exemplified as the substituent on R, A and A'.

Illustrative, non-limiting, examples of the compounds represented by formulae (R-I), (R-II), (R-III) and (R-IV) are given below.

TABLE 1

| No. | $R_1$,$R_{1'}$ | $R_2$,$R_{2'}$ | $R_3$,$R_{3'}$ | $R_4$,$R_{4'}$ | $R_5$,$R_{5'}$ | $L_1$ | $R_6$ |
|---|---|---|---|---|---|---|---|
| R-I-1 | —OH | —$CH_3$ | —H | —$CH_3$ | —H | CH—R6 | —H |
| R-I-2 | —OH | —$CH_3$ | —H | —$CH_3$ | —H | CH—R6 | —$CH_3$ |
| R-I-3 | —OH | —$CH_3$ | —H | —$CH_3$ | —H | CH—R6 | —$C_3H_7$ |
| R-I-4 | —OH | —$CH_3$ | —H | —$CH_3$ | —H | CH—R6 | —$C_5H_{11}$ |
| R-I-5 | —OH | —$CH_3$ | —H | —$CH_3$ | —H | CH—R6 | —TMB |
| R-I-6 | —OH | —$CH_3$ | —H | —$CH_3$ | —H | CH—R6 | —$C_9H_{19}$ |
| R-I-7 | —OH | —$CH_3$ | —H | —$CH_3$ | —H | S | — |
| R-I-8 | —OH | —$CH_3$ | —H | —$C_2H_5$ | —H | S | — |
| R-I-9 | —OH | —$CH_3$ | —H | —$C_4H_9$(t) | —H | S | — |
| R-I-10 | —OH | —$C_4H_9$(t) | —H | —$CH_3$ | —H | CH—R6 | —H |
| R-I-11 | —OH | —$C_4H_9$(t) | —H | —$CH_3$ | —H | CH—R6 | —$CH_3$ |
| R-I-12 | —OH | —$C_4H_9$(t) | —H | —$CH_3$ | —H | CH—R6 | —TMB |
| R-I-13 | —OH | —$C_4H_9$(t) | —H | —$C_2H_5$ | —H | CH—R6 | —Ph |
| R-I-14 | —OH | —CHex | —H | —$CH_3$ | —H | S | — |
| R-I-15 | —OH | —$C_4H_9$(t) | —H | —$C_2H_5$ | —H | S | — |
| R-I-16 | —OH | —$C_2H_5$ | —H | —$C_4H_9$(t) | —H | CH—R6 | —H |
| R-I-17 | —OH | —$C_2H_5$ | —H | —$C_4H_9$(t) | —H | CH—R6 | —$CH_3$ |
| R-I-18 | —OH | —$C_2H_5$ | —H | —$C_4H_9$(t) | —H | CH—R6 | —TMB |
| R-I-19 | —OH | —$CH_3$ | —H | —$C_4H_9$(t) | —H | CH—R6 | —Ph |
| R-I-20 | —OH | —$CH_3$ | —Cl | —$C_4H_9$(t) | —H | CH—R6 | —H |
| R-I-21 | —OH | —$CH_3$ | —H | —$C_4H_9$(t) | —$OCH_3$ | CH—R6 | —H |
| R-I-22 | —H | —$C_4H_9$(t) | —OH | —CPen | —H | CH—R6 | —H |
| R-I-23 | —H | —$C_4H_9$(t) | —OH | —$C_4H_9$(t) | —H | CH—R6 | —TMB |
| R-I-24 | —H | —$C_4H_9$(t) | —OH | —H | —H | CH—R6 | —H |
| R-I-25 | —H | —$C_4H_9$(t) | —OH | —H | —H | CH—R6 | —$C_3H_7$ |
| R-I-26 | —H | —$CH_3$ | —OH | —$C_4H_9$(t) | —H | CH—R6 | —TMB |
| R-I-27 | —H | —$C_2H_5$ | —OH | —$C_4H_9$(t) | —H | CH—R6 | —H |
| R-I-28 | —H | —$CH_3$ | —OH | —$C_2H_5$ | —H | CH—R6 | —TMB |
| R-I-29 | —H | —$CH_3$ | —OH | —$CH_3$ | —H | S | — |
| R-I-30 | —H | —$CH_3$ | —OH | —$CH_3$ | —Cl | S | — |
| R-I-31 | —H | —$CH_3$ | —OH | —$C_2H_5$ | —H | S | — |
| R-I-32 | —H | —$C_2H_5$ | —OH | —$C_2H_5$ | —H | S | — |
| R-I-33 | —H | —$C_2H_5$ | —OH | —$CH_3$ | —Cl | S | — |
| R-I-34 | —H | —$CH_3$ | —OH | —$C_4H_9$(t) | —H | S | — |
| R-I-35 | —H | —CHex | —OH | —$C_4H_9$(t) | —H | S | — |

TMB: 1,3,3-trimethylbutyl group
CPen: cyclopentyl group
CHex: cyclohexyl group
(R-I)

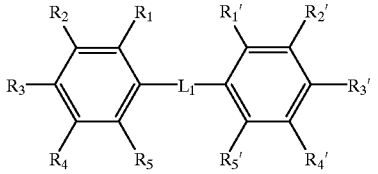

TABLE 2

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-36 | —OH | —$CH_3$ | —H | —$CH_3$ | —H | —H | —$CH_3$ | —OH | —$CH_3$ | —H | CH—R6 | —H |
| R-I-37 | —OH | —$C_4H_9$(t) | —H | —$CH_3$ | —H | —H | —$CH_3$ | —OH | —$CH_3$ | —H | CH—R6 | —H |
| R-I-38 | —OH | —$CH_3$ | —H | —$CH_3$ | —H | —H | —CHex | —OH | —$CH_3$ | —H | CH—R6 | —$CH_3$ |
| R-I-39 | —OH | —$C_4H_9$(t) | —H | —$CH_3$ | —H | —H | —$CH_3$ | —OH | —$CH_3$ | —H | CH—R6 | —$CH_3$ |
| R-I-40 | —OH | —$CH_3$ | —H | —$CH_3$ | —H | —H | —$CH_3$ | —OH | —$CH_3$ | —H | CH—R6 | —TMB |
| R-I-41 | —OH | —$C_4H_9$(t) | —H | —$CH_3$ | —H | —H | —$CH_3$ | —OH | —$CH_3$ | —H | CH—R6 | —TMB |
| R-I-42 | —OH | —$CH_3$ | —H | —$CH_3$ | —H | —H | —$CH_3$ | —OH | —$CH_3$ | —H | S | — |
| R-I-43 | —OH | —$C_4H_9$(t) | —H | —$CH_3$ | —H | —H | —$CH_3$ | —OH | —$CH_3$ | —H | S | — |
| R-I-44 | —OH | —$CH_3$ | —H | —$CH_3$ | —H | —H | —CHex | —OH | —$CH_3$ | —H | S | — |

CHex: cyclohexyl group
(R-I)

TABLE 2-continued

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|

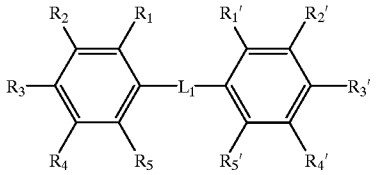

TABLE 3

| No. | $R_1$,$R_{1'}$ | $R_2$,$R_{2'}$ | $R_3$,$R_{3'}$ | $R_4$,$R_{4'}$ | $R_5$,$R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-1 | —OH | —$C_4H_9$(t) | —H | —$CH_3$ | —H | —OH | —$CH_3$ | —$CH_3$ | —H | CH—R6 | —H | CH—R6 | —$CH_3$ | 1 |
| R-II-2 | —OH | —$CH_3$ | —H | —$CH_3$ | —H | —OH | —$C_2H_5$ | —$CH_3$ | —H | CH—R6 | —TMB | CH—R6 | —$CH_3$ | 1 |
| R-II-3 | —OH | —$C_4H_9$(t) | —H | —$CH_3$ | —H | —OH | —$CH_3$ | —$CH_3$ | —H | CH—R6 | —H | CH—R6 | —TMB | 3 |
| R-II-4 | —OH | —$CH_3$ | —H | —$CH_3$ | —H | —OH | —$C_2H_5$ | —$CH_3$ | —H | CH—R6 | —TMB | CH—R6 | —TMB | 2 |
| R-II-5 | —H | —$C_4H_9$(t) | —OH | —$CH_3$ | —H | —OH | —$CH_3$ | —$CH_3$ | —H | S | — | CH—R6 | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |
| R-II-7 | —H | —$C_4H_9$(t) | —OH | —$CH_3$ | —H | —OH | —$CH_3$ | —$CH_3$ | —H | S | — | S | — | 2 |
| R-II-8 | —H | —$CH_3$ | —OH | —$CH_3$ | —H | —OH | —$C_2H_5$ | —$CH_3$ | —H | S | — | CH—R6 | —TMB | 3 |

(R-II)

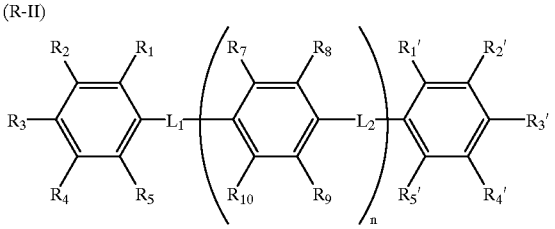

TABLE 4

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_{16}H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{33}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | —DHP | —H |

DHP: 2,4-dihydroxyphenyl group (R-III)

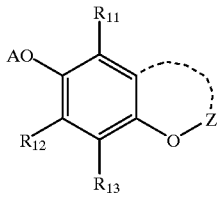

(Z-1)

TABLE 4-continued

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|

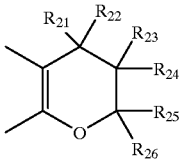

TABLE 5

| No. | Z | $R_{11}$,$R_{11'}$ | $R_{12}$,$R_{12'}$ | $R_{13}$,$R_{13'}$ | $R_{21}$,$R_{22}$ | $R_{21'}$,$R_{22'}$ | $R_{23}$,$R_{24}$ | $R_{23'}$,$R_{24'}$ | A |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

(R-III)

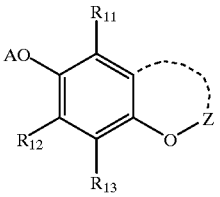

(Z-2)

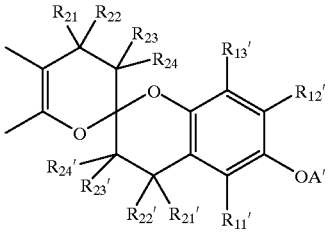

TABLE 6

| No. | Z | $R_{11}$ | $R_{12}$ | $R_{13}$ | $R_{21}$,$R_{22}$ | $R_{23}$,$R_{24}$ | $R_{25}$,$R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —$CH_3$ | —H | —H | —H |

(R-IV)

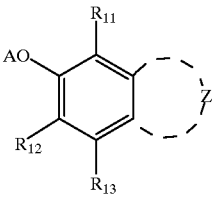

(Z-3)

TABLE 6-continued

| No. | Z | $R_{11}$ | $R_{12}$ | $R_{13}$ | $R_{21}$,$R_{22}$ | $R_{23}$,$R_{24}$ | $R_{25}$,$R_{26}$ | A |
|---|---|---|---|---|---|---|---|---|
| 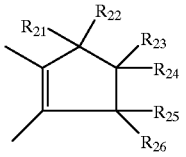 | | | | | | | | |

TABLE 7

| No. | Z | $R_{11}$,$R_{11'}$ | $R_{12}$,$R_{12'}$ | $R_{13}$,$R_{13'}$ | $R_{21}$,$R_{21'}$ | $R_{22}$,$R_{22'}$ | $R_{23}$,$R_{24}$ | $R_{23'}$,$R_{24'}$ | A |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_5$ | —$CH_3$ | —H | —H | —H |

(R-IV)

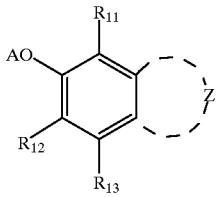

(Z-4)

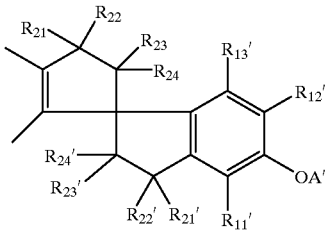

The reducing agent is preferably used in an amount of $1\times10^{-3}$ mol to 10 mol, more preferably $1\times10^{-2}$ to 1.5 mol per mol of silver. The reducing agent and the ultrahigh contrast promoting agent are preferably used in a molar ratio between $1:10^{-3}$ and $1:10^{-1}$.

In the practice of the invention, the reducing agent is used by dispersing or dissolving it in water or a water-miscible organic solvent such as methanol, ethanol, dimethylformamide, and acetonitrile.

A well-known emulsifying dispersion method is used for dissolving the reducing agent with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the reducing agent in powder form in water in a ball mill, colloidal mill or ultrasonic mixer.

It is especially preferred to add the reducing agent by the solid dispersion method. Although the photosensitive layer having the reducing agent added in an amount of $1\times10^{-2}$ to 10 mol per mol of silver tends to lower its physical strength, such strength lowering is minimized when the reducing agent is added as a solid dispersion. For example, 1 to 50% by weight of the reducing agent is admixed with water with the aid of 1 to 30% by weight of the solids of a surfactant as a dispersant and the resulting water slurry is dispersed by a dispersing machine. It is desired to continue dispersion until a submicron dispersion having a mean particle size of up to 1 $\mu$m, typically 0.01 to 1 $\mu$m is obtained.

A thermoplastic resin is used in the photothermographic material of the invention. The resin used herein should be thermoplastic at a drying temperature in order that a coating be formed by applying the resin onto a support and heat drying it. The drying temperature generally ranges from room temperature to about 100° C. Drying is done at a temperature in this range. Examples of the thermoplastic resin used herein include polyvinyl alcohol, cellulose acetate butyrate, cellulose acetate propionate, styrene-butadiene copolymers, polyvinyl acetal resins (e.g., polyvinyl formal and polyvinyl butyral), polyurethanes, polyvinyl acetate, and acrylic resins (inclusive of acrylic rubber). These polymers have a weight average molecular weight Mw of about 1,000 to about 100,000.

An aqueous dispersion of the thermoplastic resin may be formed by any well-known dispersion method. For example, an aqueous dispersion is prepared by adding 5 to 80% by weight of a plasticizer (e.g., saturated or unsaturated higher fatty acid ester) to resin powder, adding 1 to 30% by weight of an alkylarylsulfonate as a dispersant, heating the mixture at a temperature above Tg for dissolving solids, agitating the solution in an emulsifying/dispersing machine while gradually adding water, thereby once forming a dispersion of water-in-resin type, and further gradually adding water to induce phase transition, thereby forming a dispersion of resin-in-water type. Preferably the dispersion has as small a particle size as possible. The particle size can be controlled by adjusting the viscosity of a resin solution phase and the shearing force of the dispersing machine. Preferably the dispersion is comminuted to a mean particle size of up to 1 μm, typically 0.01 μm to 1 μm.

There may be used a commercially available water dispersion, for example, an aqueous dispersion of polyvinyl butyral available under the trade name of Butvar Dispersion FP or BR from Monsanto Co. Other commercially available water dispersions include water dispersions of anionic polyurethane available under the trade name of Adeka Bontiter HUX-350, 232, 551, 290H, and 401 from Asahi Denka Industry K.K., water dispersions of aqueous vinyl urethane available under the trade name of KR-120, KR-134, KC-1, KR-2060, and KR-173 from Koyo Sangyo K.K., and water dispersions of aqueous vinyl urethane available under the trade name of Maruka UV Bond #10, #31 and #50 from Saiden Chemical K.K. Styrene-butadiene copolymers are commercially available as Sumitomo SBR latex from Sumitomo Chemical K.K., JSR latex from Japan Synthetic Rubber K.K., and Nipol latex from Nippon Zeon K.K. under the standardized trade number of #1500, #1502, #1507, #1712, and #1778. Acrylic latex generally known as acryl rubber is commercially available in the trade name of Nipol AR31 and AR32 and Hycar 4021 from Nippon Zeon K.K.

The vinyl butyral homopolymer or copolymer used in the polyvinyl butyral water dispersion should preferably have a weight average molecular weight Mw of about 1,000 to about 100,000. The copolymer should preferably have a vinyl butyral content of at least 30% by weight.

The urethane homopolymer or copolymer used in the polyurethane water dispersion should preferably have a weight average molecular weight Mw of about 1,000 to about 100,000. The copolymer should preferably have a urethane content of at least 30% by weight.

The styrene-butadiene copolymer latex should preferably have a styrene to butadiene weight ratio of from 10/90 to 90/10, more preferably from 20/80 to 60/40. A copolymer known as high-styrene latex having a styrene/butadiene ratio of from 60/40 to 90/10 is preferably used in admixture with a low styrene content latex having a styrene/butadiene ratio of from 10/90 to 30/70 because the photosensitive layer is improved in mar resistance and physical strength. The mixing ratio (weight) is preferably from 20/80 to 80/20.

High-styrene latex is commercially available in the trade name of JSR 0051 and 0061 from Japan Synthetic Rubber K.K. and Nipol 2001, 2057 and 2007 from Nippon Zeon K.K. Low styrene content latexes are commercially available ones other than the examples of high-styrene latex, for example, JSR #1500, #1502, #1507, #1712, and #1778.

In the practice of the invention, the thermoplastic resin is used in such a range that it may effectively function as a binder. The effective range may be properly determined by those skilled in the art without undue experimentation. Taken at least as a measure for holding the organic silver salt in the film, the weight ratio of the binder to the organic silver salt is preferably in the range of from 15:1 to 1:2, more preferably from 8:1 to 1:1.

In the aqueous dispersion of thermoplastic resin, silver halide is dispersed as well as the organic silver salt. The silver halide and organic silver salt will be described later.

The photothermographic material according to the invention is processed by a photothermographic process to form photographic images. As described in the preamble, such photothermographic materials are disclosed in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

The photothermographic material according to the invention preferably contains a reducible silver source (e.g., organic silver salt), a catalytic amount of a photocatalyst (e.g., silver halide), a toner for controlling the tonality of silver, and a reducing agent, typically dispersed in a binder (typically organic binder) matrix. Although the photothermographic material is stable at room temperature, it is developed merely by heating at an elevated temperature (e.g., higher than 60° C., preferably higher than 80° C., also preferably lower than 120° C., more preferably 80 to 120° C.) after exposure, that is, without a need for a processing solution. Upon heating, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, eventually forming an image.

In the photothermographic material of the invention, the ultrahigh contrast promoting agent participates in the image forming process to form a super-high contrast image. Formation of super-high contrast images assisted by ultrahigh contrast promoting agents is well known for systems to be processed with solutions, but not known for heat developing systems using organic silver salts and is thus quite unexpected.

The photothermographic material of the invention has at least one photosensitive layer on a support. It is acceptable to form only a photosensitive layer on a support although it is preferred to form at least one non-photosensitive layer on the photosensitive layer. In order to control the quantity or wavelength distribution of light transmitted to the photosensitive layer, a filter layer may be formed on the same side as or on the opposite side to the photosensitive layer, or a dye or pigment may be contained in the photosensitive layer. The dye used to this end is preferably selected from the compounds described in Japanese Patent Application No. 11184/1995. The photosensitive layer may consist of two or more strata. Also a combination of high/low sensitivity strata or low/high sensitivity strata may be used for the adjustment of gradation.

In the photothermographic material of the invention, various additives such as surfactants, antioxidants, stabilizers, plasticizers, UV absorbers, and coating aids may be used. These additives may be added to any of the photosensitive layer, non-photosensitive layer and other layers.

Addition of toners is quite desirable. Preferred toners are disclosed in Research Report No. 17029. Exemplary toners include imides such as phthalimide; cyclic imides, pyrazolin-5-ones, and quinazolinones such as succinimide, 3-phenyl-2-pyrazoline-5-one, 1-phenylurazol, quinazoline and 2,4-thiazolizinedione; naphthalimides such as N-hydroxy-1,8-naphthalimide; cobalt complexes such as cobalt hexamine trifluoroacetate; mercaptans such as 3-mercapto-1,2,4-triazole; N-(aminomethyl) aryldicarboxyimides such as N-(dimethylaminomethyl) phthalimide; combinations of a blocked pyrazole, an isothiuronium derivative and a certain optical bleaching agent such as a combination of N,N'-hexamethylenebis(1-carbamoyl-3,5-dimethylpyrazole), 1,8-(3,6-dioxaoctane)bis(isothiuroniumtrifluoroacetate) and 2-tribromomethylsulfonyl-benzothiazole; merocyanine dyes such as 3-ethyl-5-{(3-ethyl-2-benzothiazolinylidene)-1-methylethylidene}-2-thio-2,4-oxazolidinedione; phthalazinones, phthalazinone derivatives or metal salts thereof such as 4-(1-naphthyl)phthalazinone, 6-chlorophthalazinone, 5,7-dimethyloxyphthalazinone and 2,3-dihydro-1,4-phthalazinedione; combinations of phthalazinones with sulfinic acid derivatives such as a combination of 6-chlorophthalazinone with sodium benzenesulfinate and a combination of 8-methylphthalazinone with sodium p-trisulfonate; combinations of phthalazines with phthalic acid; combinations of phthalazines (inclusive of phthalazine adducts) with maleic anhydride and at least one of phthalic acid, 2,3-naphthalenedicarboxylic acid and o-phenylenic acid derivative and anhydrides thereof (e.g., phthalic acid, 4-methylphthalic acid, 4-nitrophthalic acid, and tetrachlorophthalic anhydride); quinazolinediones, benzoxazine, and naphthoxazine derivatives; benzoxazine-2,4-diones such as 1,3-benzoxazine-2,4-dione; pyrimidine and asym-triazines such as 2,4-dihydroxypyrimidine; and tetraazapentalene derivatives such as 3,6-dimercapto-1,4-diphenyl-1H,4H-2,3a,5,6a-tetraazapentalene. Phthalazones are preferred toners.

The silver halide which is useful as a catalytic amount of photocatalyst may be selected from photosensitive silver halides such as silver bromide, silver iodide, silver chloride, silver chlorobromide, silver iodobromide, and silver chloroiodobromide, with an iodide ion being preferably contained. The silver halide may be added to the image forming layer by any desired method whereupon the silver halide is disposed close to the reducible silver source. In general, the silver halide is contained in an amount of 0.75 to 30% by weight based on the reducible silver source. The silver halide may be prepared by converting a silver soap moiety through reaction with a halide ion, or by preforming silver halide and adding it upon generation of a soap, or a combination of these methods. The latter method is preferred. The photosensitive silver halide will be described later.

The reducible silver source is preferably selected from silver salts of organic and hetero-organic acids containing a reducible silver ion source, especially silver salts of long chain aliphatic carboxylic acids having 10 to 30 carbon atoms, especially 15 to 25 carbon atoms. Also preferred are complexes of organic or inorganic silver salts with ligands having an overall stability constant to silver ion in the range of 4.0 to 10.0. Preferred examples of the silver salt are described in Research Disclosure Nos. 17029 and 29963. Included are silver salts of organic acids (e.g., gallic acid, oxalic acid, behenic acid, stearic acid, palmitic acid, and lauric acid); silver salts of carboxyalkylthioureas (e.g., 1-(3-carboxypropyl)thiourea and 1-(3-carboxypropyl)-3,3-dimethylthiourea); silver complexes of polymeric reaction products of aldehydes and hydroxy-substituted aromatic carboxylic acids (exemplary aldehydes are formaldehyde, acetaldehyde and butylaldehyde and exemplary hydroxy-substituted acids are salicylic acid, benzoic acid, 3,5-dihydroxybenzoic acid, and 5,5-thiodisalicylic acid); silver salts or complexes of thioenes (e.g., 3-(2-carboxyethyl)-4-hydroxymethyl-4-(thiazoline-2-thioene and 3-carboxymethyl-4-thiazoline-2-thioene); silver complexes or salts of nitrogenous acids such as imidazoles, pyrazoles, urazoles, 1,2,4-thiazoles, 1H-tetrazoles, 3-amino-5-benzylthio-1,2,4-triazoles, and benzotriazoles; silver salts of saccharin and 5-chlorosalicylaldoxime; and silver salts of mercaptides. The preferred silver source is silver behenate. The reducible silver source is preferably used in an amount of up to 5 g/m$^2$, more preferably 0.3 to 3.0 g/m$^2$ of silver.

An antifoggant may be contained in the photosensitive material according to the invention. The most effective antifoggant was mercury ion. Use of a mercury compound as the antifoggant in photosensitive material is disclosed, for example, in U.S. Pat. No. 3,589,903. Mercury compounds, however, are undesirable from the environmental aspect. Preferred in this regard are non-mercury antifoggants as disclosed, for example, in U.S. Pat. Nos. 4,546,075 and 4,452,885 and JP-A 57234/1984.

Especially preferred non-mercury antifoggants are compounds as disclosed in U.S. Pat. Nos. 3,874,946 and 4,756,999 and heterocyclic compounds having at least one substituent represented by —C($X^1$)($X^2$)($X^3$) wherein $X^1$ and $X^2$ are halogen atoms such as F, Cl, Br, and I, and $X^3$ is hydrogen or halogen. Preferred examples of the antifoggant are shown below.

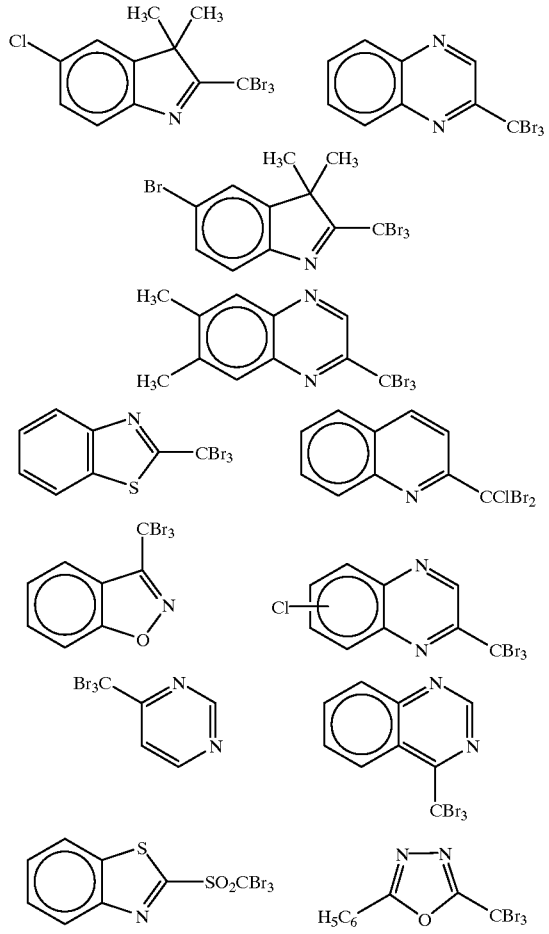

-continued

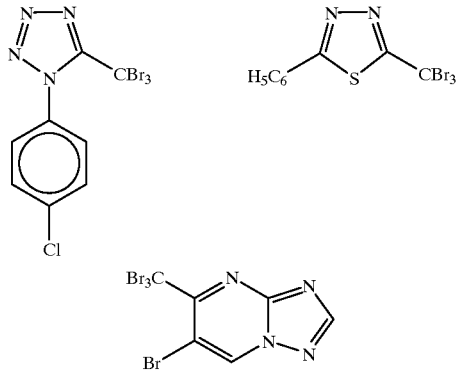

More preferred antifoggants are disclosed in U.S. Pat. No. 5,028,523, British Patent Application Nos. 92221383.4, 9300147.7 and 9311790.1 by the same assignee as the present invention.

In the heat developable photosensitive material according to the invention, there may be used sensitizing dyes as disclosed in JP-A 159841/1988, 140335/1985, 231437/1988, 259651/1988, 304242/1988, and 15245/1988, U.S. Pat. Nos. 4,639,414, 4,740,455, 4,741,966, 4,751,175, and 4,835,096.

Useful sensitizing dyes which can be used herein are described in Research Disclosure, Item 17643 IV-A (December 1978, page 23), ibid., Item 1831 X (August 1978, page 437) and the references cited therein.

It is advantageous to select a sensitizing dye having appropriate spectral sensitivity to the spectral properties of a particular light source of various scanners. Exemplary sensitizing dyes include (A) simple merocyanines as described in JP-A 162247/1985 and 48653/1990, U.S. Pat. No. 2,161,331, W. German Patent No. 936,071, and Japanese Patent Application No. 189532/1991 for argon laser light sources; (B) tri-nucleus cyanine dyes as described in JP-A 62425/1975, 18726/1979 and 102229/1984 and merocyanines as described in Japanese Patent Application No. 103272/1994 for He-Ne laser light sources; (C) thiacarbocyanines as described in JP-B 42172/1973, 9609/1976, 39818/1980, JP-A 284343/1987 and 105135/1990 for LED light sources and red semiconductor laser light sources; and (D) tricarbocyanines as described in JP-A 191032/1984 and 80841/1985 and 4-quinoline nucleus-containing dicarbocyanines as described in JP-A 192242/1984 and 67242/1991 (as represented by formulae (IIIa) and (IIIb) therein) for infrared semiconductor laser light sources.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization.

For exposure of the photothermographic material of the invention, an Ar laser (488 nm), He—Ne laser (633 nm), red semiconductor laser (670 nm), and infrared semiconductor laser (780 nm and 830 nm) are preferably used.

A dye-containing layer may be included as an antihalation layer in the photothermographic material of the invention. For Ar laser, He—Ne laser, and red semiconductor laser light sources, a dye is preferably added so as to provide an absorbance of at least 0.3, more preferably at least 0.8 at an exposure wavelength in the range of 400 to 750 nm. For infrared semiconductor laser light sources, a dye is preferably added so as to provide an absorbance of at least 0.3, more preferably at least 0.8 at an exposure wavelength in the range of 750 to 1500 nm. The dyes may be used alone or in admixture of two or more. The dye may be added to a dye layer disposed on the same side as the photosensitive layer adjacent to the support or a dye layer disposed on the support opposite to the photosensitive layer.

In the photothermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—SM and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H) quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0..001 to 1.0 mol, more preferably 0.01 to 0.3 mol per mol of silver.

Next, the photosensitive silver halide is described. A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is preferably up to 0.20 μm, more preferably 0.01 μm to 0.15 μm, most preferably 0.02 μm to 0.12 μm. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the plane indices (Miller indices) of an outer surface of silver halide grains. Preferably silver halide grains have a high proportion of {100} plane featuring high spectral sensitization efficiency upon adsorption of a spectral sensitizing dye. The proportion of {100} plane is preferably at least 50%, more preferably at least 65%, most preferably at least 80%. Note that the proportion of Miller index {100} plane can be determined by the method described in T. Tani, J. Imaging Sci., 29, 165 (1985), utilizing the adsorption dependency of {111} plane and {100} plane upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. The metal complex is preferably contained in an amount of 1 nmol to 10 mmol, more preferably 10 nmol to 100 μmol per mol of silver. Illustrative metal complex structures are those described in JP-A 225449/1995. Preferred among cobalt and iron complexes are hexacyano metal complexes. Illustrative, non-limiting examples include a ferricyanate ion, ferrocyanate ion, and hexacyanocobaltate ion. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl)tellurides, bis(oxycarbonyl)ditellurides, bis(carbamoyl)ditellurides, compounds having a P═Te bond, tellurocarboxylic salts, Te-organyltellurocarboxylic esters, di(poly)tellurides, tellurides, telluroles, telluroacetals, tellurosulfonates, compounds having a P—Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

In the practice of the invention, photosensitive silver halide is preferably used in an amount of 0.01 mol to 0.5 mol, more preferably 0.02 mol to 0.3 mol, most preferably 0.03 mol to 0.25 mol per mol of the organic silver salt.

It is preferred to contain the organic silver salt in the silver halide emulsion layer. With respect to a method and conditions of admixing the separately prepared photosensitive silver halide and organic silver salt in order to introduce the organic silver salt in the silver halide emulsion layer, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

In the practice of the invention, the photosensitive material should preferably have a total silver coverage of about 0.1 to 5 g/m$^2$, more preferably about 0.3 to 3.0 g/m$^2$.

The photothermographic material of the present invention is preferably a one side photosensitive material having at least one photosensitive layer containing a silver halide emulsion on one surface of a support and a backing layer (or back layer) on the other surface.

In the present invention, a matte agent may be added to the one side photosensitive material for improving transportation. The matte agent used herein is generally a microparticulate water-insoluble organic or inorganic compound. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary waterdispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, ureaformaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the backing layer should preferably have a degree of matte as expressed by a Bekk smoothness of 10 to 250 seconds, more preferably 50 to 180 seconds.

In the photosensitive material of the invention, the matte agent is preferably contained in an outermost surface layer, a layer functioning as an outermost surface layer, a layer close to the outer surface or a layer functioning as a so-called protective layer.

In the practice of the invention, the binder used in the backing layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly (vinyl pyrrolidone), casein, starch, poly(acrylic acid), poly (methyl methacrylate), polyvinyl chloride, poly(methacrylic acid), copoly(styrene-maleic anhydride), copoly(styrene-acrylonitrile), copoly(styrene-butadiene), poly(vinyl acetals) (e.g., poly(vinyl formal) and poly(vinyl butyral)), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

In the practice of the invention, the backing layer preferably has a maximum absorbance of 0.3 to 2 in a desired wavelength range, more preferably an IR absorbance of 0.5 to 2 and an absorbance of 0.001 to less than 0.5 in the visible range. Most preferably it is an anti-halation layer having an optical density of 0.001 to less than 0.3.

Where anti-halation dyes are used in the practice of the invention, such a dye may be any compound which has sufficiently low absorption in the visible region and provides the backing layer with a preferred absorbance spectrum profile. Exemplary anti-halation dyes are the compounds described in JP-A 13295/1995, U.S. Pat. No. 5,380,635, JP-A 68539/1990, page 13, lower-left column to page 14, lower-left column, and JP-A 24539/1991, page 14, lower-left column to page 16, lower-right column though not limited thereto.

A backside resistive heating layer as described in U.S. Pat. Nos. 4,460,681 and 4,374,921 may be used in a photosensitive photothermographic photographic image system according to the present invention.

A surface protective layer may be provided in the photosensitive material according to the present invention for the purpose of preventing adhesion of an image forming layer. The surface protective layer is also preferably formed by coating of an aqueous system.

The protective layer is based on a binder. Exemplary binders are naturally occurring polymers and synthetic resins, for example, gelatin, polyvinyl alcohol, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The binder is preferably used in the form of an aqueous solution or water dispersion.

In the protective layer, wax and inorganic or organic matte agents (e.g., silica particles and polymethyl methacrylate particles) are preferably contained. Preferably the matte agent is added so as to provide a degree of matte as expressed by a Bekk smoothness of 500 to 10,000 seconds. Also, the protective layer may further contain some or all of a reducing agent, ultrahigh contrast promoting agent, toner, antifoggant, and development promoter which are previously mentioned.

In the emulsion layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699.

The support used herein includes sheets of paper, synthetic paper, paper laminated with a synthetic resin (e.g., polyethylene, polypropylene and polystyrene), plastic films (e.g., polyethylene terephthalate, polycarbonate, polyimide, nylon, and cellulose triacetate), metal sheets (e.g., aluminum, aluminum alloy, zinc, iron, and copper), metal-laminated or metallized paper sheets and plastic films, styrene polymers having a syndiotactic structure, and heat treated polyethylene. Plastic materials having a higher glass transition temperature are also preferred, and for example, polyether ethyl ketone, polystyrene, polysulfone, polyether sulfone, and polyarylates are useful.

Especially preferred is polycarbonate. Polycarbonate film is generally prepared by a melt method generally known as a melt extrusion method or a solvent method of dissolving polycarbonate in an organic solvent and casting the solution. The melt extrusion method is especially preferred because a further improvement in dimensional stability is expectable.

More particularly, a film is prepared by heat melting polycarbonate and extruding the melt, followed by cooling for solidification. The extruder used herein may be either of single and twin shaft extruders which may be vented or not. The extruder is preferably equipped with a mesh filter for comminuting or removing secondary agglomerates and removing debris and foreign matter. Extruding conditions are not critical and may be properly selected in accordance with a particular situation. Preferably extrusion is carried out through a T die at a temperature between the melting point of the polymer and the decomposition temperature plus 50° C.

At the end of extrusion, the resulting preform or raw sheet is cooled and solidified. The coolant used herein may be any of gases, liquids, and metal rolls. Where a metal roll is used, it is preferably combined with such means as air knife, air chamber, touch roll and electrostatic charging which is effective for preventing thickness variation or waving. The cooling or solidifying temperature is generally in the range between 0° C. and the glass transition temperature of the raw sheet plus 30° C., preferably between the glass transition temperature of the raw sheet minus 50° C. and the glass transition temperature. A cooling rate may be properly selected in the range of 200° C./sec. to 3° C./sec. The thus obtained raw sheet generally has a gage of about 100 to 5,000 $\mu$m.

The solidified raw sheet is then oriented monoaxially or biaxially. In the case of biaxial orientation, the sheet may be simultaneously oriented in longitudinal and transverse directions or sequentially oriented first in one direction and then in another direction. Orientation may be done in one stage or multiple stages. The orienting method used herein includes tentering, stretching between rolls, bubbling utilizing a pneumatic pressure, and rolling. Any desired one may be selected from such orienting methods or any desired combination may be used. The orienting temperature is generally set between the glass transition temperature and the melting point of the raw sheet. In the case of sequential or multi-stage orientation, the first stage is preferably carried out at a temperature between the glass transition temperature and the crystallizing temperature of the raw sheet and the second stage at a temperature between the glass transition temperature and the melting point of the raw sheet. The orienting rate is preferably 1×10 to $1\times10^7$%/min., more preferably $1\times10^3$ to $1\times10^7$%/min. An area stretching factor of at least 8, especially at least 10 is preferred because a transparent film satisfying smoothness, humid dimensional stability and heat dimensional stability would not be obtained by stretching at an area factor of less than 8.

Preferably the film oriented under the above-mentioned conditions is further thermoset for improving dimensional stability at elevated temperature, heat resistance, and strength balance within the film plane. Thermosetting may be done in a conventional manner. Usually, the oriented film is held for ½ to 1,880 seconds at a temperature in the range between the glass transition temperature and the melting point of the film, especially between the upper limit temperature of a service environment and the melting point of the film while the film is kept under a tensioned, loosened or shrinkage limited condition. Thermosetting may be carried out two or more times under a different set of conditions within the above-mentioned range. Also thermosetting may be carried out in an inert gas atmosphere such as argon gas and nitrogen gas. In order to produce a least heat shrinkable film, any one of thermosetting steps is preferably carried out in a shrinkage limited condition. The proportion of shrinkage limit is up to 20%, preferably up to 15% in a longitudinal and/or transverse direction.

Stretching and thermosetting conditions are preferably adjusted such that the magnitude $|\Delta n|$ of complex refraction index of the film may be up to $40\times10^{-3}$ whereby a film having improved physical properties including transparency can be obtained.

It is desired that various coating layers of the photothermographic material including a silver halide emulsion layer, anti-halation layer, intermediate layer, and backing layer be firmly bonded to the support. To this end, any of well-known methods may be used as described below.

(1) A first method is to establish a bonding force by first subjecting the support to surface activating treatment and applying a coating layer directly thereto. The surface activating treatment used herein includes chemical treatment, mechanical treatment, corona discharge treatment, flame treatment, UV treatment, radio frequency treatment, glow discharge treatment, active plasma treatment, laser treatment, mixed acid treatment, and ozone oxidizing treatment.

(2) A second method is by forming an undercoat layer on the support after similar surface activating treatment or without surface activating treatment, and then applying a coating layer thereto. See U.S. Pat. Nos. 2,698,241, 2,764,520, 2,864,755, 3,462,335, 3,475,193, 3,143,421, 3,501,301, 3,460,944, 3,674,531, UKP 788,365, 804,005, 891,469, JP-B 43122/1973 and 446/1976.

By virtue of these surface treatments, the support which is originally hydrophobic is given more or less polar groups on its surface or increased in crosslinking density on its surface whereby the affinity force to polar groups of components in the undercoating solution is increased or the surface becomes more adherent to form a firm bond.

With respect to the construction of the undercoat layer, various implements are contemplated. Included are a multilayer technique of forming on the support a first undercoat layer in the form of a layer which is well adherent to the support and forming thereon a second undercoat layer in the form of an affinitive resin layer which is well adherent to a photographic layer, and a single layer technique of forming on the support a single layer of a resin containing both a hydrophobic group and an affinitive group.

Among the surface treatments associated with the first method (1), corona discharge treatment is best known in the art. Corona discharge treatment can be carried out by any of well-known techniques as disclosed in JP-B 5043/1973, 51905/1972, JP-A 28067/1972, 83767/1974, 41770/1976, and 131576/1976. A discharge frequency of 50 Hz to 5,000 kHz, especially 5 kHz to several hundred kHz is appropriate. A too low discharge frequency would generate a less stable discharge, with which pinholes can be formed in a substrate. A too high discharge frequency requires a special device for impedance matching, increasing the cost of installation. With respect to the strength of treatment on a substrate, about 0.001 to 5 kV·A·min/m$^2$, preferably 0.01 to 1 kV·A·min/m$^2$ is appropriate for improving the wettability of ordinary plastic films such as polyesters and polyolefins. The gap between the electrode and the dielectric roll is usually 0.5 to 2.5 mm, preferably 1.0 to 2.0 mm.

Glow discharge treatment is very effective surface treatment in most cases. Glow discharge treatment can be carried out by any of well-known techniques as disclosed in JP-B 7578/1960, 10336/1961, 22004/1970, 22005/1970, 24040/1970, 43480/1971, U.S. Pat. Nos. 3,057,792, 3,057,795, 3,179,482, 3,288,638, 3,309,299, 3,424,735, 3,462,335, 3,475,307, 3,761,299, UKP 997,093, and JP-A 129262/1978. Glow discharge treatment conditions include a pressure of 0.005 to 20 Torr, preferably 0.02 to 2 Torr. Under a too low pressure, surface treatment becomes less effective. Under a too high pressure, overcurrent would flow to generate sparks, which is not only dangerous, but also causes substrate failure. Glow discharge is generated by applying high voltage between at least a pair of spaced apart metal plates or bars in a vacuum chamber. The applied voltage varies with the composition and pressure of the atmospheric gas although a steady glow discharge occurs at a voltage of 500 to 5,000 volts under a pressure within the above-mentioned range. A voltage in the range of 2,000 to 4,000 volts is preferred for improving adhesion. The discharge frequency is from direct current to several thousand MHz, preferably 50 Hz to 20 MHz as found in the prior art. With respect to the strength of treatment on a substrate, about 0.01 to 5 $kV \cdot A \cdot min/m^2$, preferably 0.15 to 1 $kV \cdot A \cdot min/m^2$ is appropriate to achieve desired adhesion.

With respect to the undercoating method (2), various techniques are well known in the art. In the multilayer technique, the first undercoat layer is formed of copolymers prepared from a monomer selected from vinyl chloride, vinylidene chloride, butadiene, methacrylic acid, acrylic acid, itaconic acid, and maleic anhydride and various other polymers such as polyethylene imine, epoxy resins, grafted gelatin, and nitrocellulose. The second undercoat layer is usually formed of gelatin.

In the single layer technique, supports are often swollen to achieve interfacial mixing with a hydrophilic undercoat polymer, thereby providing good adhesion.

Examples of the affinitive undercoat polymer used herein include water-soluble polymers, cellulose esters, latex polymers, and water-soluble polyesters. The water-soluble polymers include gelatin, gelatin derivatives, casein, agar, sodium alginate, starch, polyvinyl alcohol, polyacrylic acid copolymers, and maleic anhydride copolymers; the cellulose esters include carboxymethyl cellulose and hydroxyethyl cellulose; the latex polymers include vinyl chloride-containing copolymers, vinylidene chloride-containing copolymers, acrylate-containing copolymers, vinyl acetate-containing copolymers, and butadiene-containing copolymers. Among these, gelatin is most preferred.

The compound used to swell the support includes resorcin, chlororesorcin, methylresorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid, and chloral hydrate.

In the undercoat layer, various polymer hardening agents may be used. Examples of the polymer hardening agent include chromium salts (e.g., chromium alum), aldehydes (e.g., formaldehyde and glutaraldehyde), isocyanates, active halogen compounds (e.g., 2,4-dichloro-6-hydroxy-s-triazine), and epichlorohydrin resins. Further in the undercoat layer, inorganic fine particles such as $SiO_2$ and $TiO_2$ and fine particles of polymethyl methacrylate (1 to 10 $\mu$m) may be contained as a matte agent.

Additionally, the undercoating solution may contain various additives if desired. Exemplary additives are surfactants, antistatic agents, anti-halation agents, coloring dyes, pigments, coating aids, and antifoggants. Where an undercoating solution for forming the first undercoat layer is used, the undercoating layer need not contain at all an etching agent such as resorcin, chloral hydrate, and chlorophenol. It is acceptable to contain such an etching agent in the undercoating solution if desired.

The undercoating solution can be coated by various coating procedures including dip coating, air knife coating, curtain coating, roller coating, wire bar coating, gravure coating, and extrusion coating using a hopper of the type described in U.S. Pat. No. 2,681,294. If desired, two or more layers may be concurrently coated by the methods described in U.S. Pat. Nos. 2,761,791, 2,941,898, 3,508,947, and 3,526,528 as well as Harazaki, "Coating Engineering," Asakura Publishing K.K., 1973, page 253.

On the support on which the undercoat layer has been formed in the above-mentioned manner, an aqueous coating solution which is prepared by dispersing an organic silver salt and a silver halide in an aqueous dispersion of a thermoplastic resin and adding a ultrahigh contrast promoting agent and other necessary components of a photosensitive layer to the aqueous dispersion is coated to form a photosensitive layer (or emulsion layer). The coating technique may be the same as used in undercoating.

Usually, a surface protective layer is formed on the photosensitive layer. The photosensitive layer and the protective layer may be coated either concurrently or separately. After coating, the coating(s) is heat dried. Heat drying usually uses a temperature of 30 to 100° C. and a time of about ½ to 10 minutes.

It is noted that the reducing agent may be added to the protective layer as by dissolving it in an organic solvent. However, adding the reducing agent to the photosensitive layer is preferred. In this case, a water dispersion of the reducing agent prepared by a solid dispersion method is added to the aqueous coating solution for the photosensitive layer.

The backing or back layer may be similarly formed by coating.

EXAMPLES

Examples of the invention are given below by way of illustration and not by way of limitation.

Example 1

Preparation of Support

A biaxially oriented polycarbonate film with a gage of 100 $\mu$m (Mitsubishi Gas Chemical K.K.) on either surface was subject to glow discharge treatment under the following conditions.

Four bar electrodes of cylindrical shape having a diameter of 2 cm and a length of 150 cm and defining a hollow bore serving as a coolant flowpath were arranged at a spacing of 10 cm on an insulating plate and secured thereto. This electrode plate was set in a vacuum chamber. The film was passed through the chamber while the film was opposed to the electrode surface and spaced 15 cm therefrom. The feed rate of the film was controlled such that the film might undergo surface treatment for 2 seconds.

A temperature-controlled heating roll having a diameter of 50 cm was disposed in the chamber such that the film might come in contact with the heating roll a ¾ round immediately before the film passed across the electrode. A thermocouple thermometer was disposed between the heating roll and the electrode zone so as to contact the film surface. In this way, the film surface temperature was controlled to 115° C.

The vacuum chamber had a pressure of 0.2 Torr and the $H_2O$ partial pressure was 75% of the atmospheric gas. Other conditions included a discharge frequency of 30 kHz, an output of 2,500 W, a treatment strength of 0.5 $kV \cdot A \cdot min/m^2$. A temperature-controlled cooling roll having a diameter of 50 cm was disposed such that the film might come in contact with the cooling roll and be cooled to 30° C. before it was wound on a take-up roll.

An undercoat layer of the following composition was coated on either surface of the surface treated film or support.

| Undercoat layer | |
|---|---|
| Core/shell type vinylidene chloride copolymer (1) | 15 g |
| 2,4-dichloro-6-hydroxy-s-triazine | 0.25 g |
| Finely divided polystyrene (mean particle size 3 μm) | 0.05 g |
| Compound-M | 0.20 g |
| Colloidal silica (Snowtex ZL, particle size 70–100 μm, Nissan Chemical K.K.) | 0.12 g |
| Water totaling to | 100 g |

Core/shell type vinylidene chloride copolymer (1)

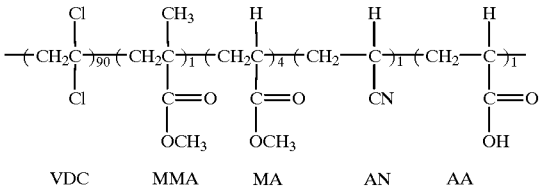

Core: VDC/MMA/MA (80 wt %)
Shell: VDC/AN/AA (20 wt %)
Mean particle size: 70 nm

Compound-M

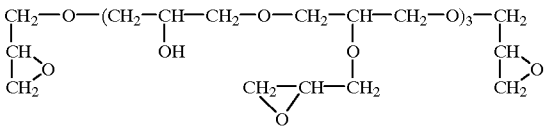

After 10% by weight of KOH was added for adjustment to pH 6, the undercoating solution was coated and dried at a temperature of 80° C. for 2 minutes to form an undercoat having a dry gage of 0.9 μm.

Preparation of Photosensitive Silver Halide Grains A

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 96:4 were added over 10 minutes by a controlled double jet method while maintaining the solution at pAg 7.7. At the same time as the start of silver nitrate addition, a salt of hexacyanoferrate(III) and a complex salt of hexachloroiridate(III) were added in an amount of $1\times10^{-5}$ mol/Ag. Thereafter, 0.3 gram of 4-hydroxy-6-methyl-1,3,3a,7-tetraazaindene was added to the solution, which was adjusted to pH 5 with NaOH. There were obtained cubic silver iodobromide grains A having a mean grain size of 0.06 μm, a coefficient of variation of projected area diameter of 8%, and a (100) plane ratio of 87%. The emulsion was desalted by adding a gelatin flocculant thereto to cause flocculation and sedimentation. 0.1 gram of phenoxyethanol was added to adjust the emulsion to pH 5.9 and pAg 7.5.

Preparation of Photosensitive Emulsion A Containing Organic Fatty Acid Silver Behenic acid, 10.6 grams, was dissolved in 300 ml of water by heating at 90° C. With thorough stirring, 31.1 ml of 1N sodium hydroxide was added to the solution, which was allowed to stand at the temperature for one hour. The solution was then cooled to 30° C., 7.0 ml of 1N phosphoric acid was added thereto, and with thorough stirring, 0.13 gram of N-bromosuccinimide was added. Thereafter, with stirring, the above-prepared emulsion of silver halide grains A was added to the solution heated at 40° C. in such an amount as to give 10 mol % of silver based on the behenic acid. Further, 25 ml of 1N silver nitrate aqueous solution was continuously added over 2 minutes. With stirring continued, the dispersion was allowed to stand for one hour.

Excess salts were removed from the aqueous dispersion by filtration. To the resulting wet dispersion, an aqueous dispersion of polyvinyl butyral, Butvar Dispersion FP was added in such an amount as to give 5 grams of polyvinyl butyral per gram of silver behenate. The mixture was dispersed again by means of a ultrasonic mixer. The polyvinyl butyral in the aqueous dispersion had a mean particle size of 0.3 μm.

Preparation of Coated Sample

Coating on the back surface side

An aqueous coating solution of the following composition was coated so as to give a coverage of 5 g/m$^2$ of polyvinyl alcohol.

| | |
|---|---|
| Polyvinyl alcohol | 6.0 g |
| Water | 100 ml |
| Boric acid | 0.2 g |
| Dye S-1 | 0.05 g |

The compounds used herein are as shown below.

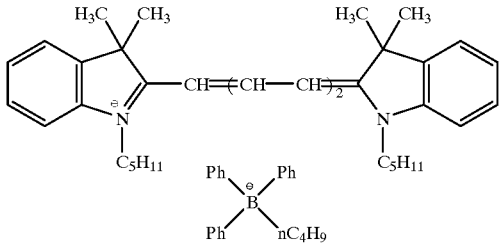

Coating on the photosensitive layer side

A photosensitive layer and a surface protective layer were concurrently coated in an overlapping manner.

The photosensitive layer was formed by coating an aqueous coating solution of the following composition so as to give a coverage of 1.5 g/m$^2$ of silver.

| | |
|---|---|
| Photosensitive emulsion A | 73 g |
| Sensitizing dye-1 (0.05% in methanol) | 2 ml |
| Antifoggant-1 (0.01% in methanol) | 3 ml |
| Antifoggant-2 (1.5% in methanol) | 8 ml |
| Antifoggant-3 (2.4% in DMF) | 5 ml |
| Dispersion of phthalazine and developing agent-1 in water (solids 28 wt %) | 10 g |
| Hydrazine derivative H-1 (1% in methanol) | 2 ml |

The compounds used herein are as shown below.

sensitizing dye-1

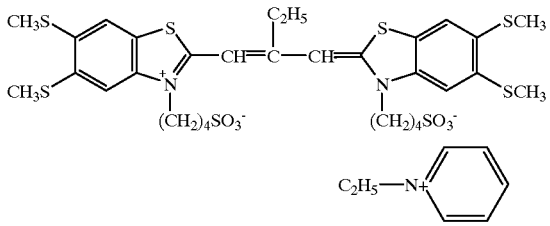

antifoggant-1

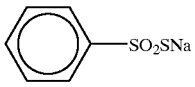

antifoggant-2

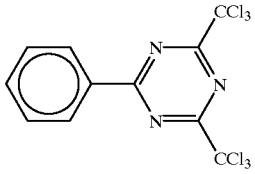

antifoggant-3

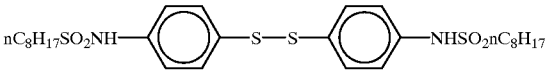

developing agent-1

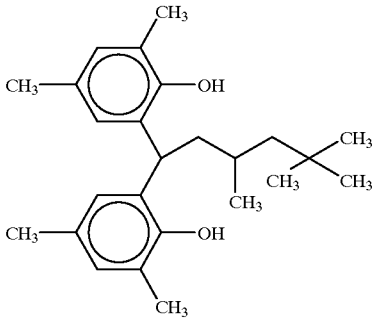

hydrazine derivative H-1

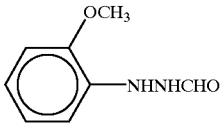

The dispersion of phthalazine and developing agent-1 in water was prepared by adding 4.6 grams of a dispersant Demor SN-B (trade name, Kao K.K.) to 5.0 grams of phthalazine and 18 grams of developing agent-1, adding 72 ml of water thereto, and agitating the mixture in a sand mill with glass beads as a medium. The dispersion had a mean particle size of 0.3 μm.

The surface protective layer was formed by coating a solution of the following composition to a wet coating thickness of 100 μm.

| | |
|---|---|
| Water | 190 ml |
| Silica (mean particle size 3.0 μm) | 0.2 g |
| Polyvinyl alcohol | 8.0 g |
| 4-methylphthalic acid | 0.72 g |
| Tetrachlorophthalic acid | 0.8 g |
| Sodium dodecylbenzenesulfonate | 2.0 g |

The coatings applied as above were dried at 60° C. for 2 minutes, obtaining a photothermographic material.

Sensitometry

The photothermographic material was exposed to xenon flash light for a light emission time of $10^{-3}$ second through an interference filter having a peak at 633 nm and then heated for development at 110° C. for 20 seconds on a heating drum. There was obtained a super-high contrast image having a maximum density (Dmax) of 3.8 and a gradient (γ) of 14.2. Note that the gradient representing the sharpness of a toe is a gradient of a straight line connecting points of density 0.1 and 1.5 on a characteristic curve. The dye in the back layer was extinguished by operating a halogen lamp for 15 seconds after the heat development.

Evaluation of Dimensional Stability

A dimensional change before and after heat development was measured to find a shrinkage of 0.005% in a longitudinal direction and an expansion of 0.008% in a transverse direction. The material showed very good dimensional stability clearing the desired value of 0.01%.

The above-mentioned procedure was repeated except that a polyethylene terephthalate support of 100 μm thick was used instead of the polycarbonate support. This sample showed a shrinkage of 0.10% in a longitudinal direction and an expansion of 0.06% in a transverse direction.

It is seen that the use of an aqueous dispersion enables the use of polycarbonate which originally has good dimensional stability to heat and hence, the manufacture of a photothermographic material having good dimensional stability. Where polyethylene terephthalate is used, the dimensional stability is not so changed from that found when an organic solvent is used. However, productivity is improved owing to the use of an aqueous dispersion.

Example 2

The procedure of Example 1 was repeated except that sensitizing dye-2 to sensitizing dye-4 were used instead of the sensitizing dye-1.

sensitizing dye-2

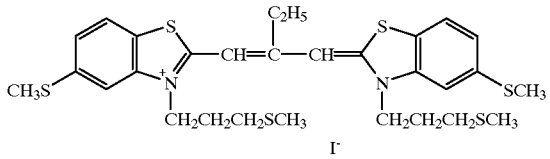

sensitizing dye-3

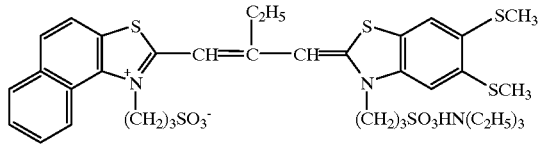

sensitizing dye-4

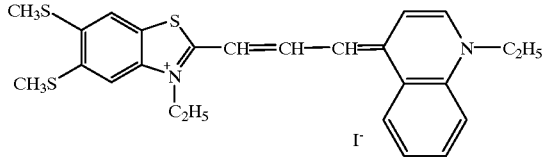

The sample produced a high contrast image having high Dmax and had good dimensional stability.

Example 3

Example 1 was repeated except that the surface protective layer and the back layer were replaced by layers of the following compositions.

| Surface protective layer | |
|---|---|
| EVAL F | 8 g |
| $H_2O$ | 90 ml |
| n-propanol | 100 ml |
| Silica (mean particle size 3.0 μm) | 0.2 g |
| 4-methylphthalic acid | 0.72 g |
| Tetrachlorophthalic acid | 0.8 g |
| Back layer | |
| EVAL F | 6.0 g |
| $H_2O$ | 50 ml |
| n-propanol | 50 ml |
| Dye S-1 | 0.05 g |

Note that EVAL F is a trade name of polyvinyl alcohol-polyethylene copolymer by Kurare K.K. and dye S-1 is as identified in Example 1.

The sample produced a high contrast image having high Dmax as in Example 1 and experienced a minimal dimensional change before and after heat development.

Example 4

Example 1 was repeated except that ultrahigh contrast promoting agents I-65, I-75, I-57, I-48, I-27, I-21, and I-16 were used instead of ultrahigh contrast promoting agent 1-58 (hydrazine derivative H-1). The results were equivalent to Example 1.

Example 5

Preparation of Aqueous Dispersion of Polyvinyl Butyral

A mixture of the following components was heated at 60° C. and agitated for 10 minutes in a homogenizer.

| | |
|---|---|
| Polyvinyl butyral | 600 g |
| Sodium dodecylbenzenesulfonate | 50 g |
| Butyl ricinoleate | 30 g |
| $H_2O$ | 200 ml |

Then 100 ml of water was added to the mixture, which was agitated for a further 20 minutes. 1.0 liter of water was further added to the mixture, which was agitated for a further 10 minutes, yielding a dispersion having a mean particle size of 0.5 μm.

Preparation and Evaluation of Photosensitive Material

A photosensitive material sample was prepared and evaluated as in Example 1 except that the above-prepared water dispersion was used instead of Butvar Dispersion FP. The results were equivalent to Example 1.

Example 6

A sample was prepared and evaluated as in Example 1 except that Adeka Bontiter HUX-350 (Asahi Denka Industry K.K.) was used instead of Butvar Dispersion FP. The sample produced a high contrast image and showed good dimensional stability as in Example 1.

Example 7

Example 1 was repeated except that 10 ml of a 5% methyl ethyl ketone solution of phthalazine and 18 ml of a 10% methyl ethyl ketone solution of developing agent-1 were added instead of 10 grams of the water dispersion of phthalazine and developing agent-1. However, the photosensitive emulsion flocculated and sedimented during agitation.

Then, a coated sample was prepared by adding the methyl ethyl ketone solutions of phthalazine and developing agent-1 to the surface protective layer in an equivalent coverage per unit area to Example 1 rather than adding to the photosensitive layer. There was obtained a high contrast image having a maximum density of 3.3 and a gradient (γ) of 12.5 upon sensitometry measurement as in Example 1. The dimensional stability was good as in Example 1.

Example 8

A sample was prepared and evaluated as in Example 1 except that JSR #1500 (Japan Synthetic Rubber K.K.) was used in an equivalent solids amount instead of Butvar Dispersion FP. There was obtained satisfactory results equivalent to Example 1.

Example 9

A sample was prepared and evaluated as in Example 8 except that a mixture of JSR #1500 and JSR 0051 in a solid weight ratio of 40/60 was used instead of JSR #1500. There was obtained satisfactory results equivalent to Example 8. The image layer had sufficiently high physical strength to be resistant to mar.

Example 10

A sample was prepared and evaluated as in Example 1 except that acrylic rubber Nipol AR31 (Nippon Zeon K.K.) was used instead of Butvar Dispersion FP. There was obtained satisfactory results equivalent to Example 1.

There has been described a method for preparing a photothermographic material using an aqueous dispersion. The photosensitive material is improved in dimensional stability and manufactured in high yields.

Although some preferred embodiments have been described, many modifications and variations may be made thereto in the light of the above teachings. It is therefore to be understood that within the scope of the appended claims, the invention may be practiced otherwise than as specifically described.

I claim:

1. A method for preparing a photothermographic material having a layer containing a reducing agent, comprising the steps of:

preparing an aqueous dispersion of a thermoplastic resin as a coating solution for forming the reducing agent-containing layer or another layer, adding an organic silver salt and a silver halide to the aqueous dispersion, further adding a ultrahigh contrast promoting agent to the aqueous dispersion to form an aqueous coating solution, applying the aqueous coating solution to a support, and heat drying the coating.

2. The method of claim 1 wherein the support is formed of polycarbonate.

3. The method of claim 1 further comprising the steps of preparing a water dispersion of the reducing agent by a solid dispersion method and adding the water dispersion to said aqueous dispersion.

4. The method of claim 1 wherein said thermoplastic resin is selected from the group consisting of polyvinyl alcohol, cellulose acetate butyrate, cellulose acetate propionate, styrene-butadiene copolymers, polyvinyl acetals, polyurethanes, polyvinyl acetate, acrylic resins and mixtures thereof.

5. The method of claim 1 wherein said thermoplastic resin is a styrene-butadiene copolymer.

6. The method of claim 1 wherein said thermoplastic resin is a polyvinyl acetal.

7. The method of claim 1 wherein said ultrahigh contrast promoting agent is a hydrazine derivative.

* * * * *